US007681666B2

(12) United States Patent
Radford et al.

(10) Patent No.: US 7,681,666 B2
(45) Date of Patent: Mar. 23, 2010

(54) EXPANDABLE REAMER FOR SUBTERRANEAN BOREHOLES AND METHODS OF USE

(75) Inventors: Steven R. Radford, The Woodlands, TX (US); Mark R. Kizziar, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/875,651

(22) Filed: Oct. 19, 2007

(65) Prior Publication Data

US 2008/0105465 A1 May 8, 2008

Related U.S. Application Data

(63) Continuation of application No. 10/999,811, filed on Nov. 30, 2004, now Pat. No. 7,549,485, which is a continuation-in-part of application No. 10/624,952, filed on Jul. 22, 2003, now Pat. No. 7,036,611.

(60) Provisional application No. 60/399,531, filed on Jul. 30, 2002.

(51) Int. Cl.
*E21B 34/10* (2006.01)

(52) U.S. Cl. ..... 175/267; 175/406

(58) Field of Classification Search ..... 175/57, 175/267, 406

See application file for complete search history.

(56) References Cited

U.S. PATENT DOCUMENTS 1,470,545 A * 10/1923 Rossignol ..... 408/156
1,678,075 A 7/1928 Phipps
1,764,373 A 6/1930 Wells et al.
1,878,260 A 9/1932 Bunker
2,069,482 A 2/1937 Seay
2,126,146 A 8/1938 Smith (Continued)

FOREIGN PATENT DOCUMENTS

EP 0707130 A2 4/1996

(Continued)

OTHER PUBLICATIONS

The Andergauge Anderreamer and Security DBS NBR, A Differentiation Between Tools, Andergauge Drilling Systems, www.andergauge.com. (4 pages).

(Continued)

*Primary Examiner*—William P Neuder
(74) *Attorney, Agent, or Firm*—TraskBritt

(57) ABSTRACT

An expandable reamer apparatus and methods for reaming a borehole are disclosed, including at least one laterally movable blade carried by a tubular body selectively positioned at an inward position and an expanded position. The at least one laterally movable blade, held inwardly by at least one blade-biasing element, may be forced outwardly by drilling fluid selectively allowed to communicate therewith or by at least one intermediate piston element. For example, an actuation sleeve may allow communication of drilling fluid with the at least one laterally movable blade in response to an actuation device being deployed within the drilling fluid. Alternatively, a chamber in communication with an intermediate piston element in structural communication with the at least one laterally movable blade may be pressurized by way of a movable sleeve, a downhole turbine, or a pump.

10 Claims, 30 Drawing Sheets

U.S. PATENT DOCUMENTS

| | | | | | |
|---|---|---|---|---|---|
| 2,427,052 | A | | 9/1947 | Grant | |
| 2,638,988 | A | | 5/1953 | Williams | |
| 2,834,578 | A | | 5/1958 | Carr | |
| 2,857,141 | A | | 10/1958 | Carpenter | |
| 2,882,019 | A | | 4/1959 | Carr et al. | |
| 3,051,255 | A | | 8/1962 | Deely | |
| 3,105,562 | A | | 10/1963 | Stone et al. | |
| 3,123,162 | A | | 3/1964 | Rowley | |
| 3,126,065 | A | | 3/1964 | Chadderdon | |
| 3,211,232 | A | | 10/1965 | Grimmer | |
| 3,433,313 | A | | 3/1969 | Brown | |
| 3,554,305 | A | | 1/1971 | Kammerer, Jr. | |
| 3,556,233 | A | | 1/1971 | Gilreath et al. | |
| 4,386,669 | A | | 6/1983 | Evans | |
| 4,458,761 | A | | 7/1984 | Van Vreeswyk | |
| 4,503,919 | A | | 3/1985 | Suied | |
| 4,565,252 | A | | 1/1986 | Campbell et al. | |
| 4,589,504 | A | | 5/1986 | Simpson | |
| 4,635,738 | A | | 1/1987 | Schillinger et al. | |
| 4,727,942 | A | | 3/1988 | Galle et al. | |
| 4,792,000 | A | * | 12/1988 | Perkin et al. | 175/228 |
| 4,842,083 | A | | 6/1989 | Raney | |
| 4,889,197 | A | | 12/1989 | Boe | |
| 5,010,967 | A | * | 4/1991 | Desai | 175/406 |
| 5,139,098 | A | | 8/1992 | Blake | |
| RE34,054 | E | * | 9/1992 | Millington et al. | 76/115 |
| 5,230,390 | A | | 7/1993 | Zastresek et al. | |
| 5,293,945 | A | | 3/1994 | Rosenhauch et al. | |
| 5,318,138 | A | | 6/1994 | Dewey et al. | |
| 5,341,888 | A | | 8/1994 | Deschutter | |
| 5,368,114 | A | | 11/1994 | Tandberg et al. | |
| 5,375,662 | A | | 12/1994 | Echols, III et al. | |
| 5,402,856 | A | | 4/1995 | Warren et al. | |
| 5,447,207 | A | | 9/1995 | Jones | |
| 5,447,208 | A | | 9/1995 | Lund et al. | |
| 5,492,186 | A | | 2/1996 | Overstreet et al. | |
| 5,495,899 | A | | 3/1996 | Pastusek et al. | |
| 5,497,842 | A | | 3/1996 | Pastusek et al. | |
| 5,582,258 | A | | 12/1996 | Tibbitts et al. | |
| 5,653,300 | A | | 8/1997 | Lund et al. | |
| 5,663,512 | A | | 9/1997 | Schader et al. | |
| 5,765,653 | A | | 6/1998 | Doster et al. | |
| 5,788,000 | A | | 8/1998 | Maury et al. | |
| 5,853,054 | A | | 12/1998 | McGarian et al. | |
| 5,957,223 | A | | 9/1999 | Doster et al. | |
| 5,967,250 | A | | 10/1999 | Lund et al. | |
| 6,131,675 | A | | 10/2000 | Anderson | |
| 6,145,608 | A | | 11/2000 | Lund et al. | |
| RE37,127 | E | | 4/2001 | Schader et al. | |
| 6,328,117 | B1 | | 12/2001 | Berzas et al. | |
| 6,360,831 | B1 | | 3/2002 | Åkesson et al. | |
| 6,378,632 | B1 | | 4/2002 | Dewey et al. | |
| 6,408,958 | B1 | | 6/2002 | Isbell et al. | |
| 6,450,271 | B1 | | 9/2002 | Tibbitts et al. | |
| 6,460,631 | B2 | | 10/2002 | Dykstra et al. | |
| 6,499,537 | B1 | | 12/2002 | Dewey et al. | |
| 6,510,906 | B1 | | 1/2003 | Richert et al. | |
| 6,651,756 | B1 | | 11/2003 | Costo, Jr. et al. | |
| 6,695,080 | B2 | | 2/2004 | Presley et al. | |
| 6,702,020 | B2 | | 3/2004 | Zachman et al. | |
| 6,732,817 | B2 | | 5/2004 | Dewey et al. | |
| 6,739,416 | B2 | | 5/2004 | Presley et al. | |
| 6,769,500 | B2 | | 8/2004 | Miglierini | |
| 6,779,613 | B2 | | 8/2004 | Dykstra et al. | |
| 6,802,380 | B2 | | 10/2004 | Blackman | |
| 6,973,978 | B2 | | 12/2005 | Cravatte | |
| 7,036,611 | B2 | | 5/2006 | Radford et al. | |
| 7,048,078 | B2 | | 5/2006 | Dewey et al. | |
| 7,293,616 | B2 | | 11/2007 | Tulloch | |
| 7,314,099 | B2 | | 1/2008 | Dewey et al. | |
| 2002/0070052 | A1 | | 6/2002 | Armell | |
| 2004/0222022 | A1 | * | 11/2004 | Nevlud et al. | 175/57 |
| 2005/0145417 | A1 | | 7/2005 | Radford et al. | |
| 2008/0115973 | A1 | * | 5/2008 | Rives | 175/57 |

FOREIGN PATENT DOCUMENTS

| | | | |
|---|---|---|---|
| GB | 2287051 | A | 9/1995 |
| GB | 2320270 | A | 6/1998 |
| GB | 2378718 | A | 2/2003 |

OTHER PUBLICATIONS

Anderreamer Reliable Underreaming Below Casing, Andergauge Drilling Systems, www.andergauge.com. (2 pages).

EPO Search Report prepared for the Belgian Patent Office, dated Mar. 1, 2006.

UK Patent Office Search Report, dated Nov. 6, 2003 (4 pages).

UK Search Report dated Feb. 15, 2006.

European Search Report for Belgian Patent Application No. BE20050000582 20051130 (Publication No. BE1017310) dated Jun. 29, 2007.

* cited by examiner

EXPANDABLE REAMER FOR SUBTERRANEAN BOREHOLES AND METHODS OF USE

RELATED APPLICATIONS

This application is a continuation of U.S. patent application Ser. No. 10/999,811, filed Nov. 30, 2004, now U.S. Pat. No. 7,549,485, issued Jun 23, 2009, which is a continuation-in-part of U.S. patent application Ser. No. 10/624,952, filed Jul. 22, 2003, now U.S. Pat. No. 7,036,611, issued May 2, 2006, entitled EXPANDABLE REAMER APPARATUS FOR ENLARGING BOREHOLES WHILE DRILLING AND METHODS OF USE, which claims the benefit of U.S. Provisional Patent Application Ser. No. 60/399,531, filed Jul. 30, 2002, entitled EXPANDABLE REAMER APPARATUS FOR ENLARGING BOREHOLES WHILE DRILLING AND METHOD OF USE, the disclosure of each of which is incorporated by reference herein in its entirety.

BACKGROUND OF THE INVENTION

1. Field of the Invention

The present invention relates generally to an expandable reamer apparatus and methods for drilling a subterranean borehole and, more specifically, to enlarging a subterranean borehole beneath a casing or liner. The expandable reamer may comprise a tubular body configured with movable blades that may be displaced generally laterally outwardly, the movable blades having cutting elements attached thereto.

2. State of the Art

Drill bits for drilling oil, gas, geothermal wells, and other similar uses, typically comprise a solid metal or composite matrix-type metal body having a lower cutting face region and an upper shank region for connection to the bottom hole assembly of a drill string formed of conventional jointed tubular members, which are then rotated as a single unit by a rotary table or top drive drilling rig or by a downhole motor selectively in combination with the surface equipment. Alternatively, rotary drill bits may be attached to a bottom hole assembly, including a downhole motor assembly, which is in turn connected to an essentially continuous tubing, also referred to as coiled or reeled tubing, wherein the downhole motor assembly rotates the drill bit. The bit body may have one or more internal passages for introducing drilling fluid or mud to the cutting face of the drill bit to cool cutters provided thereon and to facilitate formation chip and formation fines removal. The sides of the drill bit may typically may include a plurality of laterally extending blades that have an outermost surface of a substantially constant diameter and generally parallel to the central longitudinal axis of the drill bit, commonly known as gage pads. The gage pads generally contact the wall of the borehole being drilled in order to support and provide guidance to the drill bit as it advances along a desired cutting path or trajectory.

As known within the art, blades provided on a rotary drill bit may be selected to be provided with replaceable cutting elements installed thereon, allowing the cutting elements to engage the formation being drilled and to assist in providing cutting action therealong. Replaceable cutters may also be placed adjacent to the gage area of the rotary drill bit and sometimes on the gage thereof. One type of cutting element, referred to variously as inserts, compacts, and cutters, has been known and used for providing the primary cutting action of rotary drill bits and drilling tools. These cutting elements are typically manufactured by forming a superabrasive layer or table upon a sintered tungsten carbide substrate. As an example, a tungsten carbide substrate having a polycrystalline diamond table or cutting face is sintered onto the substrate under high pressure and temperature, typically about 1450° C. to about 1600° C. and about 50 kilobars to about 70 kilobars pressure to form a polycrystalline diamond compact ("PDC") cutting element or PDC cutter. During this process, a metal sintering aid or catalyst such as cobalt may be premixed with the powdered diamond or swept from the substrate into the diamond to form a bonding matrix at the interface between the diamond and substrate.

Further, in one conventional approach to enlarge a subterranean borehole, it is known to employ both eccentric and bicenter bits to enlarge a borehole below a tight or undersized portion thereof. For example, an eccentric bit includes an extended or enlarged cutting portion that, which that, when the bit is rotated about its axis, produces an enlarged borehole. An example of an eccentric bit is disclosed in U.S. Pat. No. 4,635,738 to Schillinger et al., assigned to the assignee of the present invention. Similarly, a bicenter bit assembly employs two longitudinally superimposed bit sections with laterally offset axes. An example of an exemplary bicenter bit is disclosed in U.S. Pat. No. 5,957,223 to Doster et al., also assigned to the assignee of the present invention. The first axis is the center of the pass-through diameter, that is, the diameter of the smallest borehole the bit will pass through. Accordingly, this axis may be referred to as the pass-through axis. The second axis is the axis of the hole cut in the subterranean formation as the bit is rotated and may be referred to as the drilling axis. There is usually a first, lower and smaller diameter pilot section employed to commence the drilling, and rotation of the bit is centered about the drilling axis as the second, upper and larger diameter main bit section engages the formation to enlarge the borehole, the rotational axis of the bit assembly rapidly transitioning from the pass-through axis to the drilling axis when the full diameter, enlarged borehole is drilled.

In another conventional approach to enlarge a subterranean borehole, rather than employing a one-piece drilling structure, such as an eccentric bit or a bicenter bit to enlarge a borehole below a constricted or reduced-diameter segment, it is also known to employ an extended bottom hole assembly (extended bicenter assembly) with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the borehole, as well as the opportunity to effectively stabilize the pilot drill bit so that the pilot hole and the following reamer will traverse the path intended for the borehole. This aspect of an extended bottom hole assembly is particularly significant in directional drilling.

The assignee of the present invention has, to this end, designed as reaming structures so-called "reamer wings," which generally comprise a tubular body having a fishing neck with a threaded connection at the top thereof and a tong die surface at the bottom thereof, also with a threaded connection. U.S. Pat. Nos. 5,497,842 to Pastusek et al. and 5,495,899 to Pastusek et al., both assigned to the assignee of the present invention, disclose reaming structures including reamer wings. The upper midportion of the reamer wing tool includes one or more longitudinally extending blades projecting generally radially outwardly from the tubular body, the outer edges of the blades carrying PDC cutting elements. The midportion of the reamer wing also may include a stabilizing pad having an arcuate exterior surface having a radius that is the same as or slightly smaller than the radius of the pilot hole on the exterior of the tubular body and longitudinally below the blades. The stabilizer pad is characteristically placed on the opposite side of the body with respect to the reamer blades so that the reamer wing tool will ride on the pad due to the resultant force vector generated by the cutting of the blade or blades as the enlarged borehole is cut. U.S. Pat. No. 5,765,653 to Doster et al., assigned to the assignee of the present invention, discloses the use of one or more eccentric stabilizers placed within or above the bottom hole reaming assembly to permit ready passage thereof through the pilot hole or pass-through diameter, while effectively radially stabilizing the assembly during the hole-opening operation thereafter.

Conventional expandable reamers may include blades pivotably or hingedly affixed to a tubular body and actuated by way of a piston disposed therein as disclosed by U.S. Pat. No. 5,402,856 to Warren. In addition, U.S. Pat. No. 6,360,831 to Åkesson et al. discloses a conventional borehole opener comprising a body equipped with at least two hole-opening arms having cutting means that may be moved from a position of rest in the body to an active position by way of a face thereof that is directly subjected to the pressure of the drilling fluid flowing through the body.

Notwithstanding the prior approaches to drill or ream a larger-diameter borehole below a smaller-diameter borehole, the need exists for improved apparatus and methods for doing so. For instance, bicenter and reamer wing assemblies are limited in the sense that the pass-through diameter is nonadjustable and limited by the reaming diameter. Further, conventional reaming assemblies may be subject to damage when passing through a smaller-diameter borehole or casing section.

BRIEF SUMMARY OF THE INVENTION

The present invention generally relates to an expandable reamer having movable blades that may be positioned at an initial smaller diameter and expanded to a subsequent diameter to ream or drill a larger-diameter borehole within a subterranean formation. Such an expandable reamer may be useful for enlarging a borehole within a subterranean formation, since the expandable reamer may be disposed within a borehole of an initial diameter and expanded, rotated, and longitudinally displaced to form an enlarged borehole therebelow or thereabove.

In one embodiment of the present invention, an expandable reamer of the present invention may include a tubular body having a longitudinal axis and a trailing end thereof for connecting to a drill string. The expandable reamer may further include a drilling fluid flow path extending through the expandable reamer for conducting drilling fluid therethrough and a plurality of generally radially and longitudinally extending blades carried by the tubular body, carrying at least one cutting structure thereon, wherein at least one blade of the plurality of blades is laterally movable. Further, the expandable reamer may include at least one blade-biasing element for holding the at least one laterally movable blade at an innermost lateral position with a force, the innermost lateral position corresponding to an initial diameter of the expandable reamer and a structure for limiting an outermost lateral position of the at least one laterally movable blade, the outermost lateral position of the at least one laterally movable blade corresponding to an expanded diameter of the expandable reamer. In one embodiment, an expandable reamer may include an actuation sleeve positioned along an inner diameter of the tubular body and configured to selectively prevent or allow drilling fluid communication with the at least one laterally movable blade in response to an actuation device engaging therewith.

For example, the expandable reamer of the present invention may include an actuation sleeve, the position of which may determine deployment of at least one movable blade therein as described below. For instance, an actuation sleeve may be disposed within the expandable reamer and may include an actuation sleeve positioned along an inner diameter of the tubular body and configured to selectively prevent or allow drilling fluid communication with the at least one laterally movable blade in response to an actuation device engaging therewith. Thus, the drilling fluid passing through the expandable reamer may be temporarily prevented by an actuation device, which may cause the actuation sleeve to be displaced by the force generated in response thereto. Sufficient displacement of the actuation sleeve may allow drilling fluid to communicate with an interior surface of the at least one movable blade, the pressure of the drilling fluid forcing the movable blades to expand laterally outwardly.

Generally, an expandable reamer may be configured with at least one cutting structure comprising at least one of a PDC cutter, a tungsten carbide compact, and an impregnated cutting structure or any other cutting structure as known in the art. For example, the at least one movable blade may carry at least one cutting structure comprising a PDC cutter having a reduced roughness surface finish. Further, a plurality of superabrasive cutters may form a first row of the plurality of superabrasive cutters positioned on the at least one laterally movable blade and may also form at least one backup row of superabrasive cutters rotationally following the first row of superabrasive cutters and positioned on the at least one laterally movable blade. Optionally, at least one of the plurality of superabrasive cutters may be oriented so as to exhibit a substantially planar surface that is oriented substantially parallel to the direction of cutting of at least one rotationally preceding superabrasive cutter. Also, at least one depth-of-cut-limiting feature may be formed upon the expandable reamer so as to rotationally precede at least one of the plurality of superabrasive cutters. In yet a further cutting element-related aspect of the present invention, at least one cutting structure may be positioned circumferentially following a rotationally leading contact point of the at least one laterally movable blade carrying the at least one cutting structure.

Also, the expandable reamer of the present invention may include at least one blade-biasing element for returning an at least one laterally movable blade to its initial unexpanded condition. For instance, the blade-biasing elements may be configured so that only a drilling fluid flow rate exceeding a selected drilling fluid flow rate may cause the movable blades to move laterally outward to their outermost radial or lateral position. Further, a plurality of blade-biasing elements may be provided for biasing at least one laterally movable blade laterally inwardly. For example, a first coiled compression spring may be positioned within a second coiled compression spring. Optionally, the first coiled compression spring may be helically wound in an opposite direction in comparison to the second coiled compression spring.

In another aspect of the present invention, an expandable reamer may include at least one blade-dampening member for limiting a rate at which the at least one laterally movable blade may be laterally displaced. For example, the at least one blade-dampening member may comprise a viscous dampening member or a frictional dampening member. In another example, a dampening member may include a body forming a chamber, the chamber configured for holding a fluid. Further, the dampening member may be configured for releasing the fluid through an aperture formed in response to development of a contact force between the at least one laterally movable blade and the at least one dampening member.

In addition, the outermost position of the movable blades, when expanded, may be adjustable. For instance, the expandable reamer of the present invention may be configured so that a spacer element may be used to determine the outermost lateral position of a movable blade. Such a spacer element may generally comprise a block or pin that may be adjusted or replaced. Alternatively, a spacer element may comprise an annular body disposed about a piston body of the at least one laterally movable blade.

In a further aspect of the present invention, a piston body of the at least one laterally moveable blade may be configured to fit within a complementarily shaped bore formed in the structure for limiting the outermost lateral position of the at least one laterally movable blade. At least one of the laterally movable blades and the structure for limiting the outermost lateral position of the at least one laterally movable blade may be configured for reducing or inhibiting misalignment of the movable blade in relation to the structure for limiting the outermost lateral position of the at least one laterally movable blade. Particularly, a piston body of the at least one movable blade may comprise a generally oval, generally elliptical, tri-lobe, dog-bone, or other arcuate shape as known in the art, and configured for inhibiting misalignment thereof with respect to an aperture within which it is positioned. Optionally, a metallic or nonmetallic layer may be deposited upon at least one of the piston body of a movable blade and a bore surface of an aperture within which it is positioned. For instance, a nickel layer may be deposited upon at least one of the piston body of a movable blade and a bore surface of an aperture within which it is positioned. Such a metallic or nonmetallic layer may be deposited by way of electroless deposition, electroplating, chemical vapor deposition, physical vapor deposition, atomic layer deposition, electrochemical deposition, or as otherwise known in the art and may be from about 0.0001 inch to about 0.005 inch thick. In one embodiment, an electroless nickel layer having dispersed TEFLON® particles may be formed upon at least one of the piston body of a movable blade and a bore surface of an aperture within which the laterally movable blade is positioned.

Further, at least a portion of a blade profile of the at least one laterally movable blade may be configured for reaming in at least one of an upward longitudinal direction and a downward longitudinal direction. Also, at least a portion of a blade profile of a movable blade may exhibit an exponential or other mathematically defined shape (e.g., radial position varies exponentially as a function of longitudinal position). Such a configuration may be relatively durable with respect to withstanding reaming of a subterranean formation.

In another exemplary aspect of the present invention, a fluid-filled chamber and at least one intermediate piston element may be configured so that the pressure developed by the drilling fluid or an external source (e.g., a turbine, pump, or mud motor) may be transmitted as a force to the at least one movable blade. Such a configuration may protect the movable assemblies from contaminants, chemicals, or solids within the drilling fluid. For instance, it may be desirable to power an expandable reamer of the present invention by way of a downhole pump or turbine-generated electrical power. Downhole pumps or turbines may allow for an expandable reamer to be used when the drilling fluid flow rates and pressures that are required to actuate the tool are not available or desirable.

One embodiment includes a drilling fluid path for communicating drilling fluid through the expandable reamer without interaction with the at least one laterally movable blade. Further, the expandable reamer may include an actuation chamber in communication with the at least one laterally movable blade that is substantially sealed from the drilling fluid path and configured for developing pressure therein for moving the at least one laterally movable blade laterally outwardly.

In another embodiment, an expandable reamer may include at least one intermediate piston element positioned between a pressure source and the at least one laterally moveable blade and configured for applying a laterally outward force to the at least one laterally moveable blade.

In a further aspect of the present invention, the structure for limiting an outermost lateral position of the at least one laterally movable blade may be affixed to the tubular body by a frangible element. Further, the frangible element may be structured for failing if the lateral position of at least one laterally movable blade exceeds the innermost lateral position and a selected upward longitudinal force is applied to the expandable reamer. Such a configuration may provide a fail-safe alternative for returning the at least one movable blade laterally inwardly if the at least one blade-biasing element fails to do so.

Further, the expandable reamer of the present invention may include a bearing pad disposed proximate to one end of a movable blade. Thus, in the direction of drilling/reaming, the bearing pad may longitudinally precede or follow the laterally movable blade. Bearing pads may comprise hardfacing material, tungsten carbide, diamond or other superabrasive materials. More particularly, a lower longitudinal region of a bearing pad may include a plurality of protruding ridges comprising wear-resistant material.

The expandable reamer of the present invention may include a wear-resistant coating deposited upon at least a portion of a surface thereof. For example, at least a portion of a surface of an expandable reamer may include at least two different hardfacing material compositions deposited thereon. Optionally, at least a portion of a surface of the expandable reamer of the present invention may include an adhesion-resistant coating.

Further, the present invention contemplates methods of reaming a borehole in a subterranean formation. Particularly, an expandable reamer apparatus may be disposed within a subterranean formation. The expandable reamer apparatus may include a plurality of blades and at least one laterally movable blade, each blade carrying at least one cutting structure. Also, the at least one laterally movable blade may be biased to a laterally innermost position corresponding to an initial diameter of the expandable reamer. Further, a drilling fluid may be flowed through the expandable reamer via a drilling fluid flow path while preventing the drilling fluid from communicating with the at least one laterally movable blade. Additionally, the drilling fluid may be allowed to communicate with the at least one laterally movable blade by introducing an actuation device into the expandable reamer apparatus. The at least one laterally movable blade may be to move to an outermost lateral position corresponding to an expanded diameter of the expandable reamer apparatus and a borehole may be reamed in the subterranean formation by rotation and displacement of the expandable reamer apparatus within the subterranean formation.

Alternatively, an expandable reamer apparatus may be disposed within a subterranean formation, the expandable reamer apparatus including a plurality of blades and having at least laterally movable blade, each blade carrying at least one cutting structure. Also, the at least one laterally movable blade may be biased to a laterally innermost position corresponding to an initial diameter of the expandable reamer.

Further, a drilling fluid may be flowed through the expandable reamer via a drilling fluid flow path while preventing the drilling fluid from communicating with the at least one laterally movable blade. A chamber in communication with an intermediate piston element may be pressurized to cause the at least one laterally movable blade to move to an outermost lateral position corresponding to an expanded diameter of the expandable reamer apparatus. Thus, the at least one laterally movable blade may be made to move to an outermost lateral position corresponding to an expanded diameter of the expandable reamer apparatus and a borehole may be reamed in the subterranean formation by rotation and displacement of the expandable reamer apparatus within the subterranean formation.

Optionally, the at least one movable blade may be caused to move laterally inwardly in response to applying a selected longitudinal force to the expandable reamer.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of the present invention can be more readily ascertained from the following description of the invention when read in conjunction with the accompanying drawings, which illustrate various embodiments of the invention and are merely representations not necessarily drawn to scale, wherein:

FIG. 5E-2 is a cross-sectional view of another alternative embodiment of a moveable blade as shown in FIG. 5A, taken through the piston body thereof;

FIG. 5F-1 is a perspective view of a movable blade of an expandable reamer according to the present invention;

FIG. 5F-2 is a perspective view of a movable blade of an expandable reamer according to the present invention including a row of backup cutting elements;

DETAILED DESCRIPTION OF THE INVENTION

The present invention relates generally to an expandable reamer apparatus for enlarging a subterranean borehole. An expandable reamer apparatus may be advantageous for passing through a bore of a certain size, expanding to another, larger size, and reaming a subterranean borehole having the larger size. For instance, an apparatus having at least one moveable blade may be utilized for passing through a casing or lining disposed within a subterranean borehole and reaming therebelow.

Figure 1A:
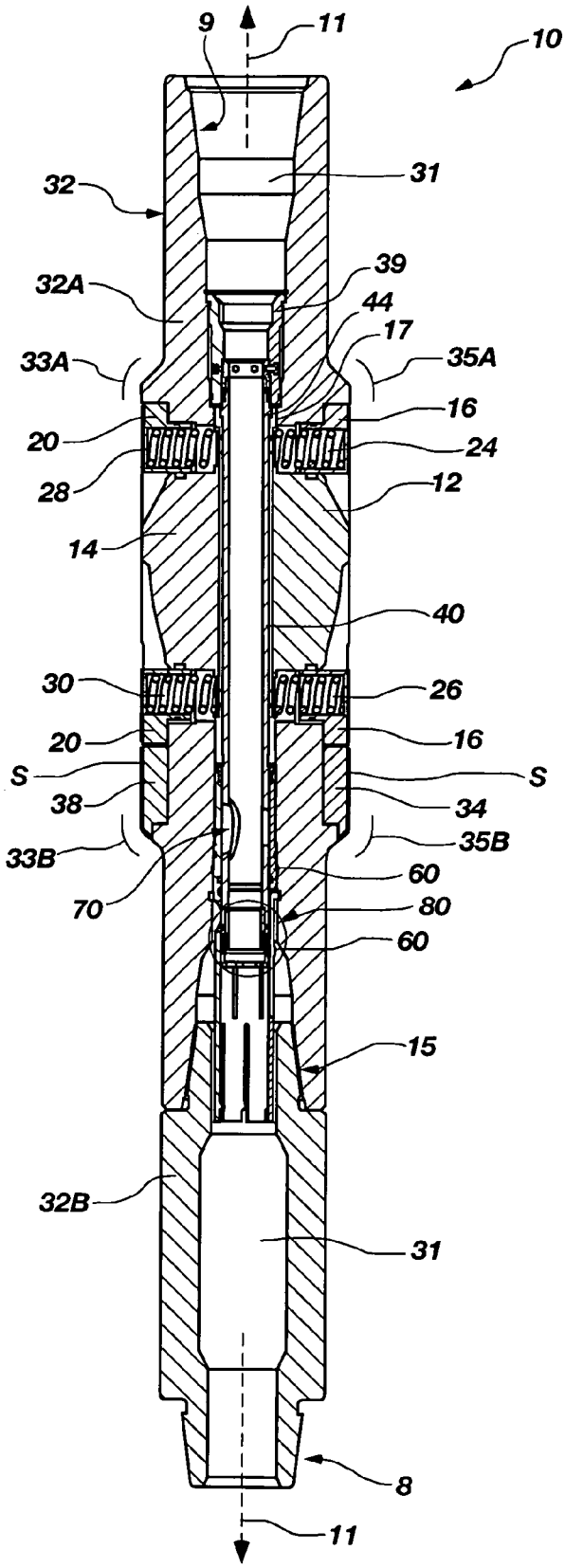
FIG. 1A is a conceptual side cross-sectional view of an expandable reamer of the present invention in a contracted state.

Referring to FIG. 1A of the drawings, a conceptual schematic cross-sectional side view of an expandable reamer 10 of the present invention is shown, the side view taken through and viewed perpendicularly to each of movable blades 12 and 14. The expandable reamer 10 may be attached to a drill pipe, casing, liner, or other tubular structure, as known in the art, for communicating fluid therein and rotating the expandable reamer 10 so as to form a borehole in a subterranean formation. Expandable reamer 10 includes a tubular body 32 including an upper tubular body section 32A and a lower tubular body section 32B with a bore 31 extending therethrough. As mentioned above, expandable reamer 10 includes movable blades 12 and 14 outwardly spaced from the centerline or longitudinal axis 11 of the tubular body 32. However, the present invention is not so limited. Rather, an expandable reamer of the present invention may include at least one movable blade, without limitation. Also, if an expandable reamer includes a plurality of movable blades, each movable blade of the plurality of movable blades may be circumferentially arranged with respect to one another and about the longitudinal axis 11 of expandable reamer 10 as desired, without limitation. Further, each of the plurality of movable blades may be arranged axially along longitudinal axis 11 at different elevations or positions, as desired, without limitation.

Tubular body 32 includes a male-threaded pin connection 8 at its lower longitudinal end as well as a female-threaded box connection 9 at its upper longitudinal end, as known in the art. As used herein, "upper" refers to a longitudinal position away from an end of expandable reamer 10 including male-threaded pin connection 8. Accordingly, as used herein, "lower" refers to a longitudinal position toward an end of expandable reamer 10 including male-threaded pin connection 8. Movable blades 12 and 14 may each carry a plurality of cutting elements, which are not shown in FIG. 1A for clarity, but are shown in FIG. 1B, as discussed hereinbelow.

Figure 1B:
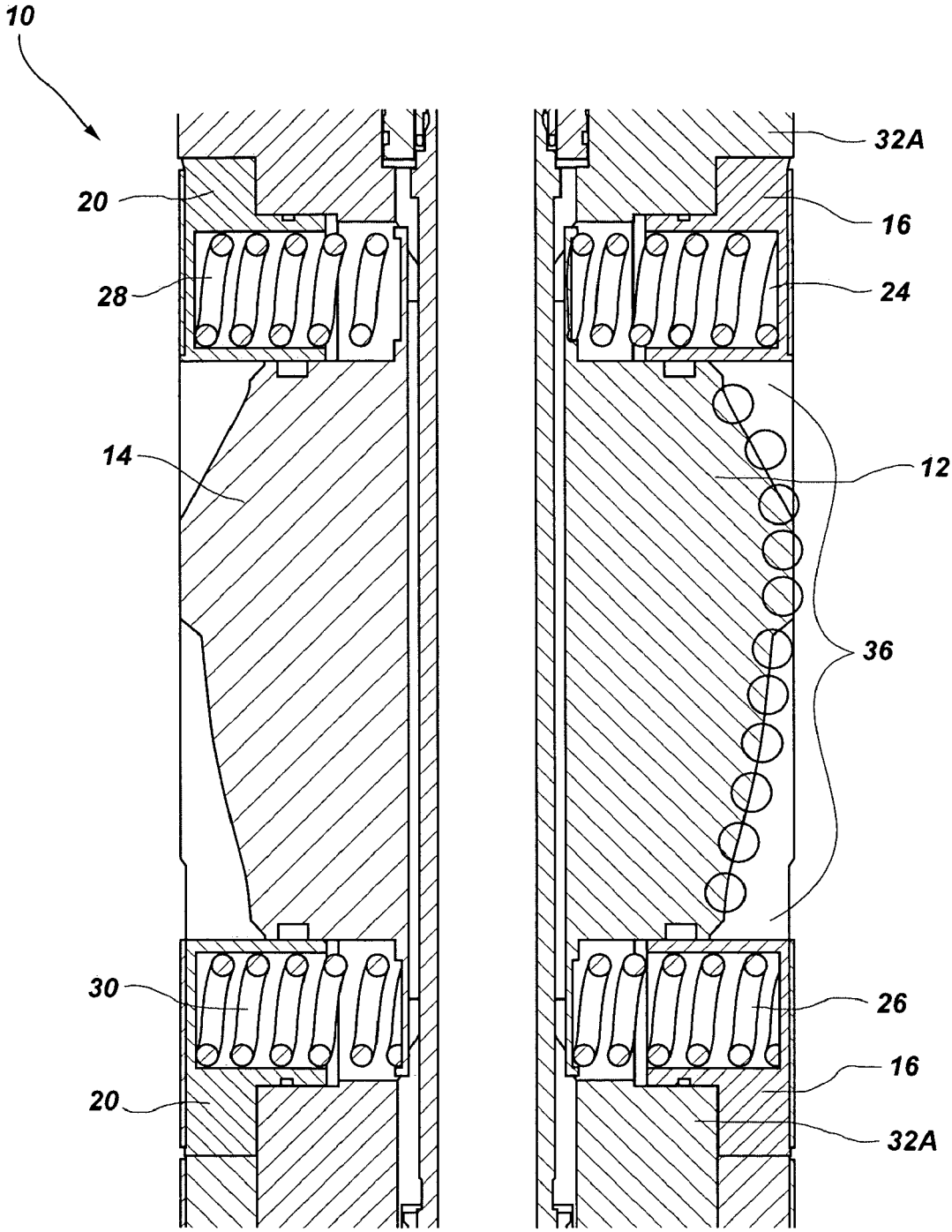
FIG. 1B is an enlarged, partial conceptual side cross-sectional view of the movable blades of the expandable reamer shown in FIG. 1A.

Particularly, FIG. 1B shows an enlarged view of movable blades 12 and 14 of reamer 10 as shown in FIG. 1A. Cutting elements 36 are shown only on movable blade 12, as the cutting elements (not shown) on movable blade 14 would be facing in the direction of rotation of the expandable reamer 10 (i.e., away from the viewer) and, therefore, may not be visible on movable blade 14 in the view depicted in FIG. 1B. Cutting elements 36 may comprise PDC cutting elements, thermally stable PDC cutting elements (also known as "TSPs"), superabrasive impregnated cutting elements, tungsten carbide cutting elements, or any other known cutting element of a material and design suitable for the subterranean formation through which a borehole is to be reamed using expandable reamer 10. One suitable superabrasive impregnated cutting element is disclosed in U.S. Pat. No. 6,510,906 to Richert et al., assigned to the assignee of the present invention, the disclosure of which is incorporated in its entirety by reference herein.

Optionally, at least one of cutting elements 36 may comprise a so-called "polished" PDC cutter. For example, U.S. Pat. Nos. 6,145,608 to Lund et al., 5,967,250 to Lund et al., 5,653,300 to Lund et al., and 5,447,208 to Lund et al., all assigned to the assignee of the present invention, and the disclosure of each is hereby incorporated in its entirety by this reference, disclose a PDC cutting element having a reduced surface roughness. Such a cutting element may be desirable for reducing friction when engaging a subterranean formation. Of course, any cutting element for drilling a subterranean formation, as known in the art, may be employed upon an expandable reamer of the present invention; without limitation.

In FIG. 1A, the expandable reamer 10 is shown in a contracted state, where the movable blades 12 and 14 are positioned radially or laterally inwardly. "Laterally," as used herein, refers to movement of a movable blade generally toward or away from the longitudinal axis 11. Thus, such movement may be along a generally radial direction, a non-radial direction, or even a partially longitudinal direction, without limitation. As shown in FIG. 1A, the outermost lateral extent of movable blades 12 and 14 may substantially coincide with or not exceed the outer diameter of the tubular body 32. Such a configuration may protect cutting elements 36 (see FIG. 1B) as the expandable reamer 10 is disposed within a bore that is smaller than the expanded diameter of the expandable reamer 10. Alternatively, the outermost lateral extent of movable blades 12 and 14 may exceed or fall within the outer diameter of tubular body 32.

Bearing pads 34 and 38 may be configured generally for preventing excessive wear to any of upper tubular body section 32A and lower tubular body section 32B, adjacent to bearing pads 34, 38, respectively. Therefore, bearing pads 34 and 38 may comprise at least one material resistant to wear, such as, for instance, tungsten carbide, diamond, or combinations thereof. Accordingly, bearing pads 34 and 38 may be affixed to upper tubular body section 32A by way of removable lock rods (lock rods 106 are shown in FIG. 4C) as described hereinbelow in greater detail. In one embodiment, bearing pads 34 and 38 may be removable from upper tubular body section 32A by way of removing the removable lock rods (not shown). Alternatively, bearing pads 34 and 38 may be affixed to upper tubular section body section 32A and, optionally, removable therefrom, by way of pins, threaded elements, splines, welding, brazing, dovetail-shaped configurations, combinations thereof, or as otherwise known in the art.

Figure 1C:
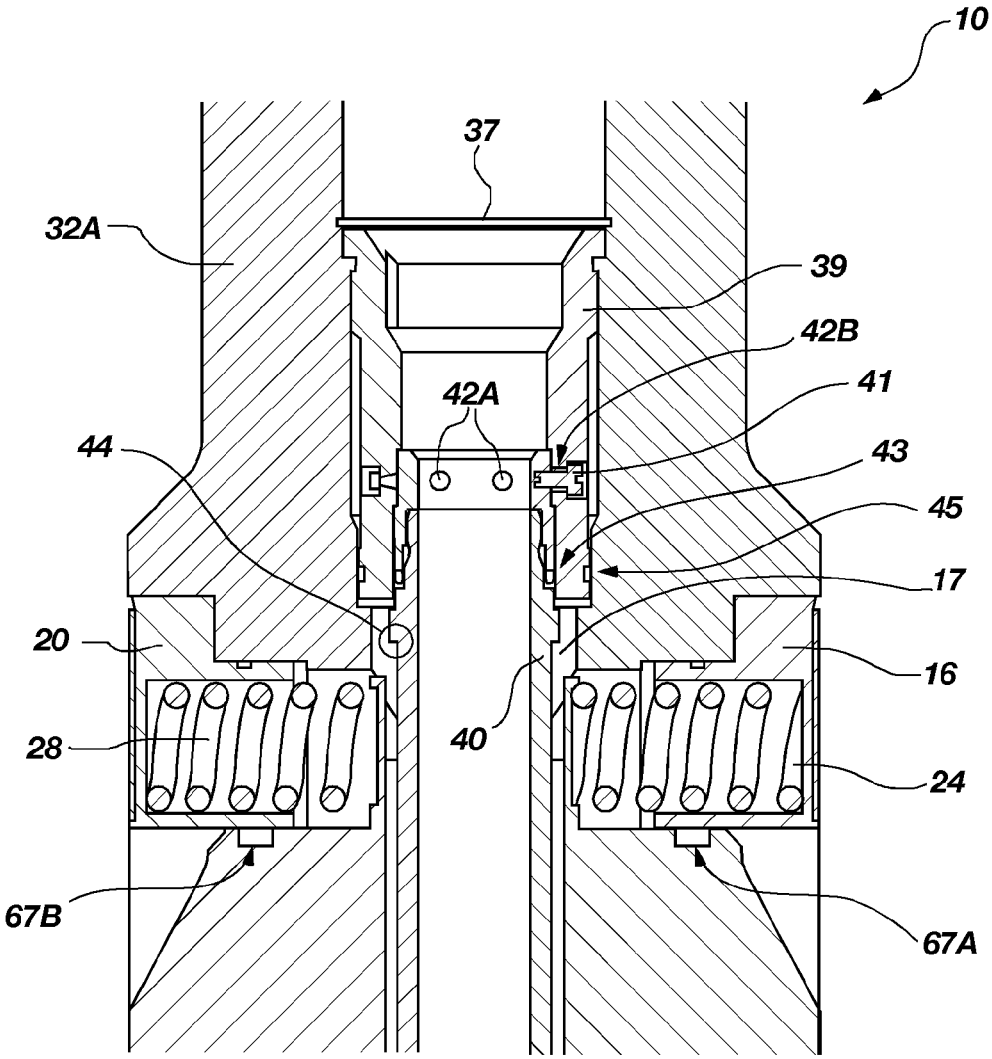
FIG. 1C is an enlarged, partial conceptual side cross-sectional view of an upper longitudinal region of the expandable reamer shown in FIG. 1A.

As shown in FIG. 1A, the relative position of actuation sleeve 40 in relation to fixed sleeve 39 may prevent drilling fluid from communicating with movable blades 12 and 14. Generally, at least one sealing element may be positioned between actuation sleeve 40 and fixed sleeve 39 for preventing flow therebetween. In further detail, FIG. 1C shows an enlarged view of an upper portion of expandable reamer 10, wherein fixed sleeve 39 may be positioned within upper tubular body section 32A and retained therein via locking element 37 (e.g., a split ring). Also, as shown in FIG. 1C, actuation sleeve 40 may be affixed to fixed sleeve 39 via at least one retention element 41 (e.g., shear pin). Furthermore, as shown in FIG. 1C, sealing element 43 may be positioned between actuation sleeve 40 and fixed sleeve 39. Sealing element 43 may sealingly engage both actuation sleeve 40 and fixed sleeve 39 and may be positioned within a cavity formed in the actuation sleeve 40 or fixed sleeve 39. Such a configuration may facilitate retention of sealing element 43 therein in response to disengagement of actuation sleeve 40 from fixed sleeve 39, described hereinbelow in greater detail. Thus, sealing element 43 in combination with sealing element 45 may substantially prevent or inhibit communication of drilling fluid with movable blades 12 and 14 in the configuration as shown in FIG. 1C. Rather, in such configuration, drilling fluid supplied to expandable reamer 10 may simply pass through the fixed sleeve 39, through the interior of actuation sleeve 40 and downwardly through the remaining portion of the expandable reamer 10.

Figure 1D:
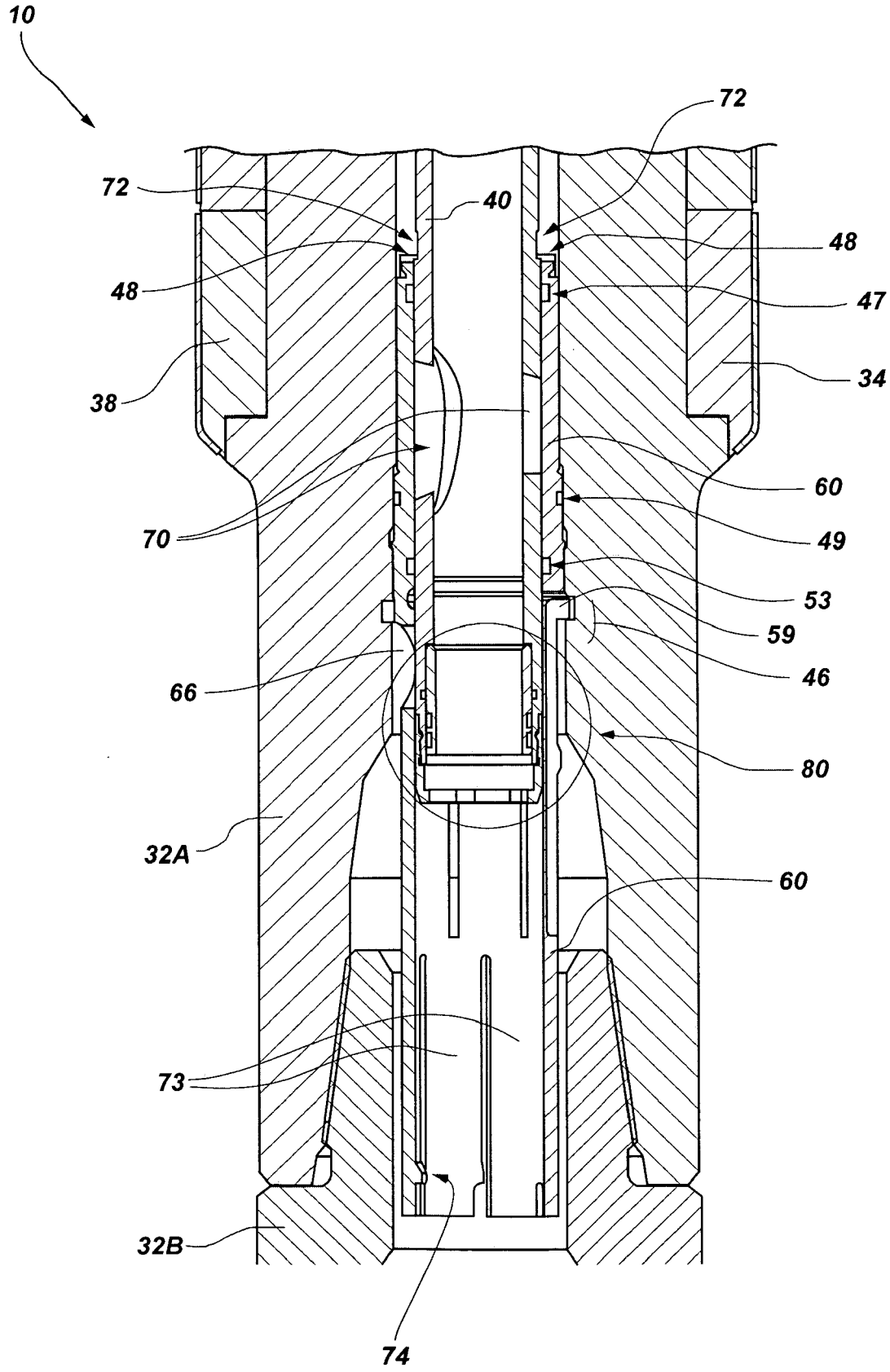
FIG. 1D is an enlarged, partial conceptual side cross-sectional view of a lower longitudinal region of the expandable reamer shown in FIG. 1A.

FIG. 1D shows an enlarged view of a lower portion of expandable reamer 10. Particularly, actuation sleeve 40 may be positioned within guide sleeve 60 and sealing elements 47 and 53 may be positioned therebetween. Sealing elements 47 and 53 may be positioned above and below apertures 70 formed in actuation sleeve 40 so as to effectively contain drilling fluid therebetween as may be communicated from apertures 70. Guide sleeve 60 may include a service access port 66. As shown in FIG. 1D, an upper collet finger flange 59 of guide sleeve 60 may fit into a shoulder feature 46 of upper tubular body section 32A. Also, guide sleeve 60 may include a plurality of longitudinally extending fingers 73, wherein at least one of the plurality of longitudinally extending fingers 73 includes an interlocking feature 74, which may be configured for at least partially engaging a complementary interlocking feature of the actuation sleeve 40, shown as annular groove 72, upon the actuation sleeve 40 moving longitudinally downwardly within guide sleeve 60, as described in greater detail hereinbelow. Such an interlocking configuration may prevent the actuation sleeve 40 from further movement after actuation.

In a further aspect of the present invention, a shock-absorbing member 48 may be positioned between the actuation sleeve 40 and the portion of the guide sleeve 60 with which contact therewith is expected. Shock-absorbing member 48 may be sized and configured for cushioning the actuation sleeve 40 as flange 44 (FIG. 1A) moves longitudinally downward and proximate to guide sleeve 60. Accordingly, shock-absorbing member 48 may be compressed between actuation sleeve 40 and guide sleeve 60. Shock-absorbing member 48 may comprise a flexible or compliant material, such as, for instance, an elastomer or a polymer. In one exemplary embodiment, shock-absorbing member 48 may comprise a nitrile rubber. Utilizing a shock-absorbing member 48 between the actuation sleeve 40 and guide sleeve 60 may reduce or prevent deformation of at least one of the actuation sleeve 40 and the guide sleeve 60 that may otherwise occur due to impact therebetween.

It should be noted that any sealing elements or shock-absorbing members disclosed herein that are included within expandable reamer 10 may comprise any material as known in the art, such as, for instance, a polymer or elastomer. Optionally, a material comprising a sealing element may be configured for relatively "high temperature" (e.g., about 400° Fahrenheit or greater) use. For instance, seals may be comprised of TEFLON®, polyetheretherketone ("PEEK™") material, a polymer material, or an elastomer, or may comprise a metal-to-metal seal. Specifically, any sealing element or shock-absorbing member disclosed herein, such as shock-absorbing member 48 and sealing elements 47 and 53, discussed hereinabove, or sealing elements 5 (FIG. 9A), 164, 62A, 62B, 62C, 67A, 67B, 67C, 343A, 343B, 345A, 345B, 352, 379, or 383A-383C discussed hereinbelow, or other sealing elements included by an expandable reamer of the present invention may comprise a material configured for relatively high temperature use.

In a further aspect of the present invention, actuation sleeve 40 may include an actuation cavity 80 configured for capturing an actuation device, wherein the actuation device is configured for causing the actuation sleeve 40 to move longitudinally downwardly. For instance, actuation cavity 80 may be configured with a thin sleeve for accepting and substantially capturing a ball as disclosed in U.S. Pat. No. 6,702,020 to Zachman et al. (e.g., FIGS. 4-7 thereof), assigned to the assignee of the present invention, the disclosure of which is incorporated herein in its entirety by this reference.

Summarizing, actuation sleeve 40 may be positioned longitudinally in a first position and affixed therein, so that movable blades 12 and 14 are effectively sealed from communication with drilling fluid passing through expandable reamer 10. Accordingly, movable blades 12 and 14 may be positioned inwardly, due to the laterally inward force of blade-biasing elements 24, 26, 28, and 30, as long as at least one retention element 41 (FIG. 1C) affixes (shown as extending within holes 42A formed within actuation sleeve 40 and holes 42B formed within fixed sleeve 39) actuation sleeve 40 to fixed sleeve 39. However, at least one retention element 41 may be sized and configured for failing (i.e., breaking) in response to a downward force exceeding a minimum selected force applied to the actuation sleeve 40. Thus, the present invention contemplates that an actuation device (e.g., a ball or other fluid-blockage element) may be deployed within drilling fluid passing through expandable reamer 10, becoming captured within the actuation cavity 80 of the actuation sleeve 40, and causing a downward force to develop thereon of sufficient magnitude to fail the at least one retention element 41 and force the actuation sleeve 40 longitudinally downward.

Figure 1E:
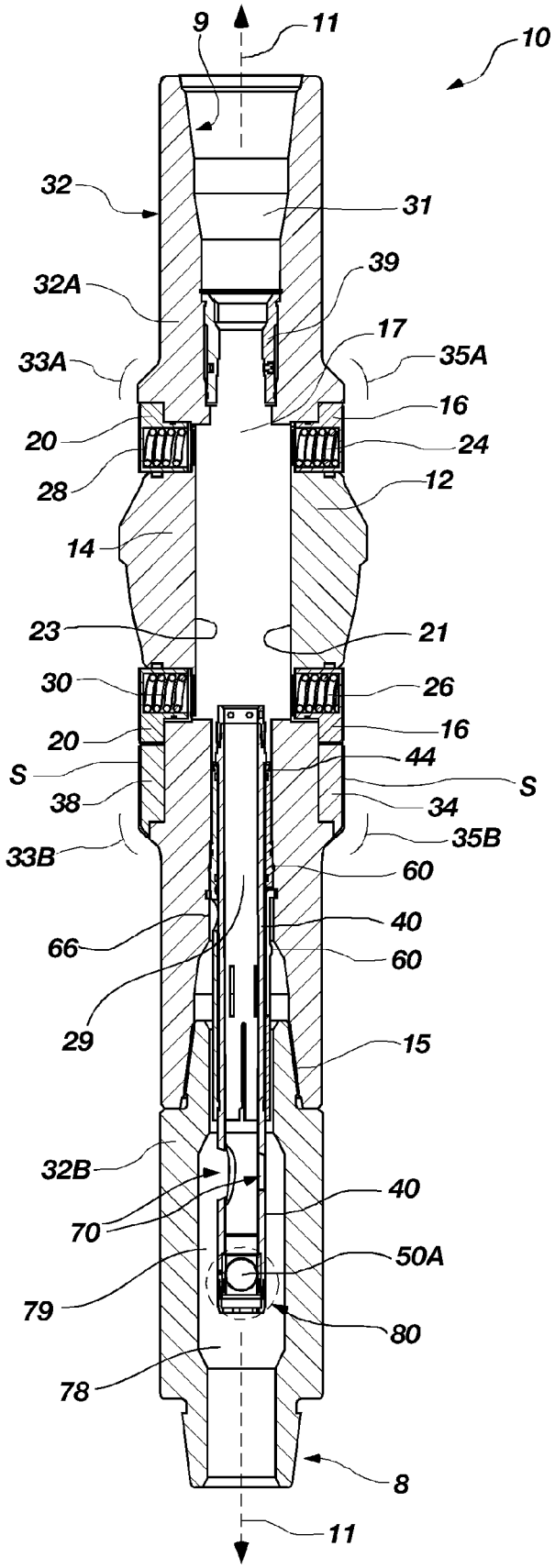
FIG. 1E is a conceptual side cross-sectional view of the expandable reamer shown in FIG. 1A in an expanded state.

For instance, as shown in FIG. 1E, substantially spherical actuation device 50A may be deployed within the drilling fluid passing through actuation sleeve 40 and may pass into the interior thereof and may be captured within actuation cavity 80 formed at a lower end thereof. Particularly, substantially spherical actuation device 50A may be configured for substantially inhibiting or blocking the flow of drilling fluid through the actuation cavity 80 of the actuation sleeve 40. In response to the substantially spherical actuation device 50A substantially inhibiting the flow of drilling fluid through the actuation sleeve 40, pressure may build; thus, a downward force may be produced upon the actuation sleeve 40. As the drilling fluid force on the actuation sleeve 40 exceeds a selected force, the at least one retention element 41 (FIG. 1C) may fail, causing the actuation sleeve 40 to move longitudinally downward within guide sleeve 60. For instance, the downward longitudinal force may increase until a release point of at least one retention element such as, for instance, at least one shear pin or a collet is exceeded. Thus, an actuation device, such as substantially spherical actuation device 50A may be dropped within expandable reamer 10. In turn, the downward longitudinal force generated by the drilling fluid pressure within the actuation sleeve 40 may cause a friable or frictional element to release the actuation sleeve 40 and cause the actuation sleeve 40 to move longitudinally downward to a position as shown in FIG. 1E. As shown in FIG. 1E, drilling fluid entering expandable reamer 10 may communicate with the movable blades 12 and 14, as described hereinbelow in greater detail.

After the actuation sleeve 40 has moved longitudinally to the lower position shown in FIG. 1E, drilling fluid flow is established through expandable reamer 10 via volume 17, bores 31 and 29, apertures 70, and lower bore areas 78 and 79. In this way, flow may be communicated through expandable reamer 10 with minimal flow restriction, if any. It should be further understood that, optionally, lower tubular body section 32B may or may not be affixed to upper tubular body section 32A, as desired.

Accordingly, in one aspect of the present invention, at least one retention element 41 (FIG.1C) may be configured for releasing the actuation sleeve 40 in response to a selected minimum magnitude of longitudinally downward force applied to the actuation sleeve 40. In one example, since each retention element of a plurality of retention elements effectively adds resistance to movement of the actuation sleeve 40, the number of retention elements 41 employed for affixing the actuation sleeve 40 to the fixed sleeve 39 may be selected in relation to a desired minimum longitudinally downward force on the actuation sleeve for releasing the actuation sleeve 40. Alternatively, a breaking strength of a frangible element such as at least one retention element 41 may be adjusted or selected via structuring the at least one retention element 41 from a suitable material and of a suitable size in relation to a desired breaking strength thereof. Of course, many other configurations for limiting or failing or otherwise releasing the actuation sleeve 40 of the present invention may be utilized, including collets, shear pins, friable elements, frictional engagement, or other elements of mechanical design as known in the art. For example, a portion of actuation sleeve 40 may be configured for failing and allowing the actuation sleeve 40 to move.

Figure 1F:
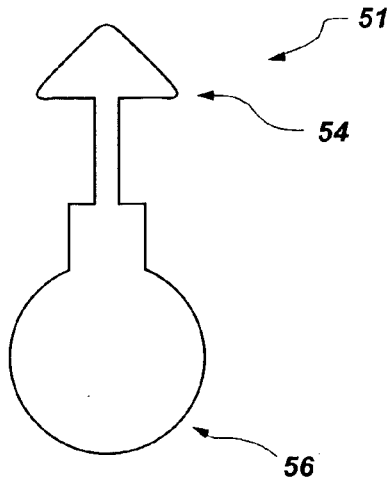
FIG. 1F is a conceptual side cross-sectional view of a retrievable actuation device.

In a further alternative, an actuation device configured for allowing expandable reamer 10 to expand may be retrievable. Put another way, after dropping a retrievable actuation device within a drill string, which may be ultimately seated within an actuation cavity 80 proximate a lower end of actuation sleeve 40, the retrievable actuation device may be removed therefrom by any process or apparatus as known in the art. In one example, a wireline may be employed for retrieving a retrievable actuation device comprising a so-called drop dart, as known in the art. For instance, in one embodiment shown in FIG. 1F, retrievable actuation device 51 may have a partially hemispherically shaped lower end 56 for mating within the actuation cavity 80 of actuation sleeve 40 and an upper end 54 configured for engagement with a retrieval apparatus, such as a wireline. Of course, the retrievable actuation device 51 may be structured for movement through a drill string (not shown) and expandable reamer 10 in an orientation wherein the partially hemispherically shaped lower end 56 precedes the upper end 54 in entering the actuation cavity 80. Upper end 54 may comprise a so-called "latch head" structured for engagement with a retrieval device lowered thereon by a wireline, as known in the art. Removing a retrievable actuation device after actuation of the expandable reamer 10 may be advantageous for allowing a wireline or other tool or device to pass through the expandable reamer 10.

It should be noted that, as shown in FIG. 1E, expandable reamer 10 will not automatically expand if drilling fluid communicates with movable blades 12 and 14. Rather, only a sufficient force on movable blades 12 and 14 to overcome blade-biasing elements 24, 26, 28, and 30 may cause movable blades 12 and 14 to move laterally outwardly. Explaining further, referring to FIG. 1E, the longitudinal position of the actuation sleeve 40 may allow drilling fluid to act upon the inner surfaces 21 and 23 of movable blades 12 and 14, respectively. In opposition to the force of the drilling fluid upon the inner surfaces 21 and 23 of movable blades 12 and 14, blade-biasing elements 24, 26, 28, and 30 may be configured to provide an inward lateral force upon movable blades 12 and 14, respectively. However, drilling fluid acting upon the inner surfaces 21 and 23 may generate a force that exceeds the force applied to the movable blades 12 and 14 by way of the blade-biasing elements 24, 26, 28, and 30, and movable blades 12 and 14 may, therefore, move laterally outwardly. Thus, expandable reamer 10 may exhibit an expanded state as shown in FIG. 1E, wherein movable blades 12 and 14 are disposed at their outermost lateral position. Thus, the flow rate of drilling fluid through expandable reamer 10 may be related to the pressure acting upon the inner surfaces 21 and 23 of movable blades 12 and 14; thus, the flow rate of drilling fluid through expandable reamer 10 may be controlled so as to cause the expansion or contraction of movable blades 12 and 14.

Thus, FIG. 1E shows an operational state of expandable reamer 10 wherein actuation sleeve 40 is positioned longitudinally so that drilling fluid flowing through expandable reamer 10 may communicate with and pressurize the volume 17 formed within the inner surfaces 21 and 23 of movable blades 12 and 14. Such pressurization may force movable blade 12 against blade-biasing elements 24 and 26 as well as force movable blade 14 against blade-biasing elements 28 and 30. Further, a pressure of the drilling fluid applied to the inner surfaces 21 and 23 may be of sufficient magnitude to cause movable blade 12 to compress blade-biasing elements 24 and 26 and matingly engage the inner surface of retention element 16 as shown in FIG. 1E. Regions 33A, 33B, 35A, and 35B may include longitudinally extending holes for disposing removable lock rods (not shown) for affixing retention elements 16 and 20 to tubular body 32, respectively. Likewise, a pressure of the drilling fluid applied to the inner surfaces 21 and 23 may be of sufficient magnitude to cause movable blade 14 to compress blade-biasing elements 28 and 30 and matingly engage the inner surface of retention element 20 as shown in FIG. 1E. Of course, movable blades 12 and 14 may also be caused to contract laterally subsequent to the actuation sleeve 40 being positioned as shown in FIG. 1E and lateral expansion of movable blades 12 and 14 for reaming. For instance, as the drilling fluid pressure decreases, blade-biasing elements 24, 26, 28, and 30 may exert a lateral inward force to bias movable blades 12 and 14 laterally inward.

Figure 1G:
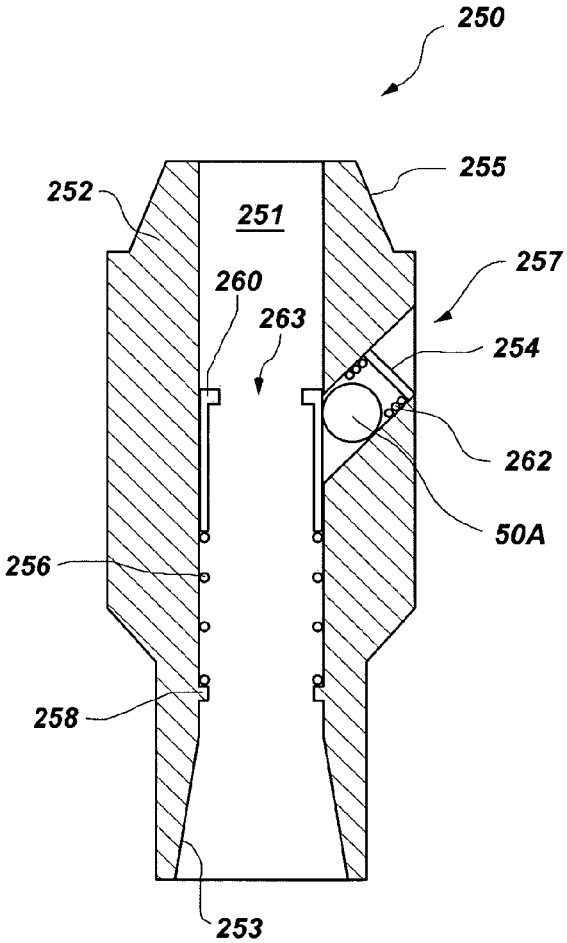
FIGS. 1G and 1H are conceptual side cross-sectional views of an actuation apparatus shown in respective operational states.
Figure 1H:
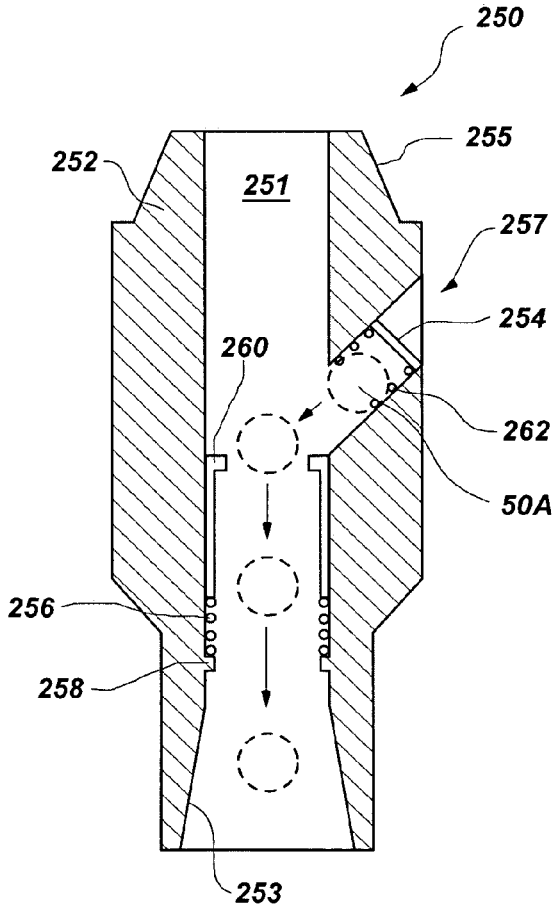

The present invention further contemplates that an actuation device may be deployed from an apparatus positioned longitudinally above an expandable reamer of the present invention. For instance, FIGS. 1G and 1H show an actuation apparatus 250 (e.g., a so-called ball-drop apparatus) comprising a tubular body 252 having a male connection 255 and a female connection 253 for connection within a drill string (not shown). Actuation apparatus 250 may form a portion of a drill string, longitudinally above an expandable reamer (e.g., expandable reamer 10) of the present invention. Actuation apparatus 250 may include a release sleeve 260 and a sleeve-biasing element 256 extending between shoulder 258 and the lower end of release sleeve 260. Substantially spherical actuation device 50A, as shown in FIG. 1G, may be positioned within recess 257 between cap element 254 and release sleeve 260.

Further, during operation, ejection element 262 (e.g., a spring) may be configured for propelling substantially spherical actuation device 50A into the bore 251 of substantially spherical actuation device 50A in response to release sleeve 260 moving longitudinally downward, as shown in FIG. 1H. Release sleeve 260 may be forced longitudinally downward by drilling fluid passing through bore 251 of actuation apparatus 250 and through orifice 263. Accordingly, orifice 263 may be sized and configured in relation to the behavior of sleeve-biasing element 256 so that a selected drilling fluid flowing through orifice 263 at a minimum selected flow rate (or greater flow rate) may cause longitudinal displacement of release sleeve 260 sufficient for allowing the substantially spherical actuation device 50A to exit recess 257. Of course, as mentioned above, ejection element 262 may force substantially spherical actuation device 50A from within recess 257 and into the bore 251 of actuation apparatus 250 as release sleeve 260 moves longitudinally downwardly to a position as shown in FIG. 1H, as illustrated by the arrows and outline representations of substantially spherical actuation device 50A. At least one of ejection element 262 and recess 257 may be configured for retaining the ejection element 262 within recess 257.

Figure 1I:
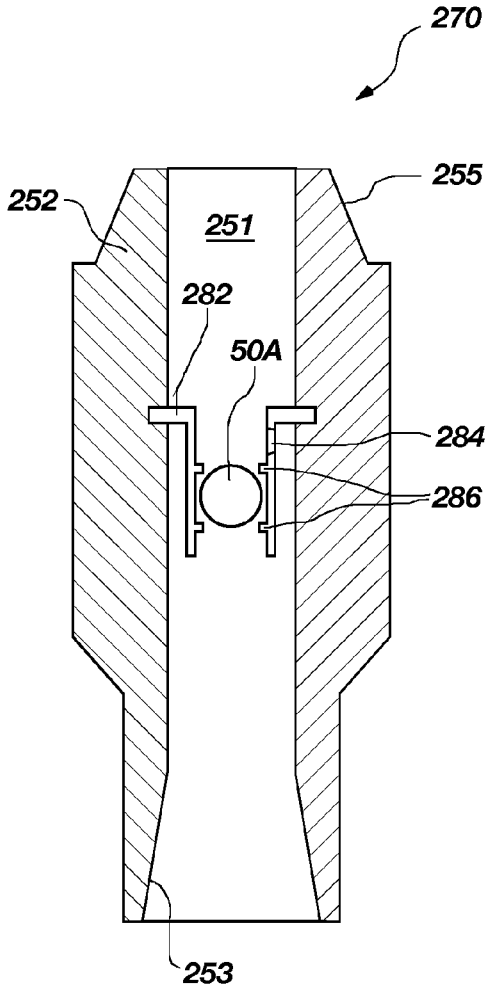
FIGS. 1I and 1J are conceptual side cross-sectional views of another actuation apparatus shown in respective operational states.
Figure 1J:
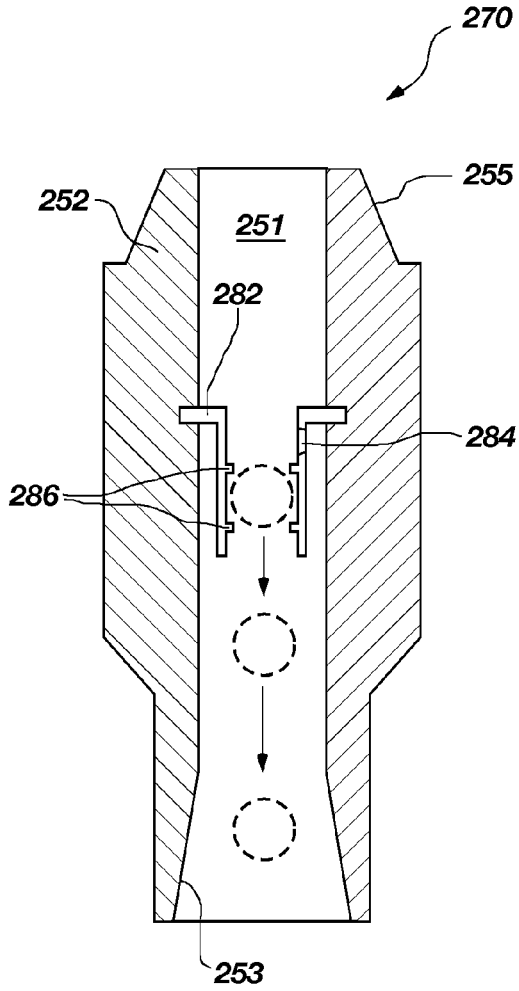

As a further alternative, an actuation device may be released by an apparatus of similarity to apparatuses disclosed in U.S. Pat. No. 5,230,390 to Zastresek, assigned to the assignee of the present invention, and the disclosure of which is incorporated herein in its entirety by this reference. For example, as shown in FIGS. 1I and 1J, an actuation apparatus 270 may include a release element 282 comprising a sleeve having inwardly radially extending features 286 (e.g., forming a collet or collet-like structure) for retaining a substantially spherical actuation device 50A against a downward longitudinal force. A downward longitudinal force may be generated upon substantially spherical actuation device 50A by drilling fluid moving longitudinally downward within bore 251 of tubular body 252 and past substantially spherical actuation device 50A through aperture 284 formed in release element 282. If a sufficient force is developed upon substantially spherical actuation device 50A, actuation device 50A may be forced through inwardly radially extending features 286 and released from release element 282, traveling longitudinally downwardly through bore 251, as shown in FIG. 1J.

Figure 1K:
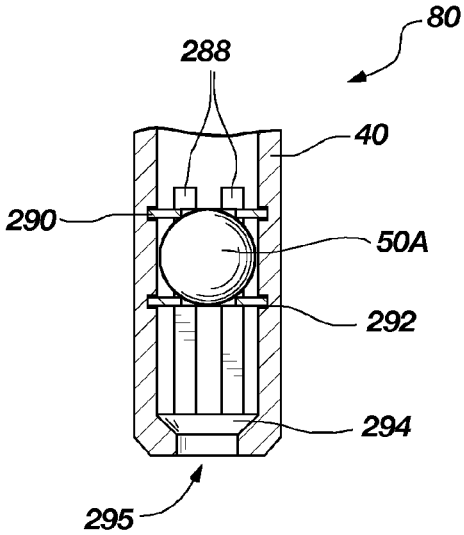
FIG. 1K is an enlarged, partial conceptual side cross-sectional view of a slotted sleeve for selectively retaining or releasing an actuation device.

In a further alternative, as shown in FIG. 1K, the lower end of actuation cavity 80 may be structured with slots 288 (i.e., as a slotted sleeve) to allow fluid to flow around the substantially spherical actuation device 50A and through exit aperture 295. Resilient annular elements 290, 292 may be secured to the interior of the actuation cavity 80, thus retaining the substantially spherical actuation device 50A therebetween. The resilient annular elements 290, 292 may comprise any flexible material configured for retaining the substantially spherical actuation device 50A above the seat 294 under selected drilling fluid flow conditions (e.g., for a selected range of drilling fluid flow rates), but will flex under increased fluid pressure to allow the actuation device 50A to drop. One exemplary embodiment for the resilient annular elements 290, 292 may comprise an annular spring washer, a snap-ring sized to retain the substantially spherical actuation device 50A in place, an O-ring, and a spring clip. A conventional resetting tool may be used to retrieve and reset the substantially spherical actuation device 50A between the resilient annular elements 290, 292 as required by the particular drilling conditions.

In another aspect of the present invention, optionally, a so-called "bypass sub" may be assembled within a drill string that includes an expandable reamer of the present invention. More specifically, a bypass sub may be structured so that if the expandable reamer becomes unable to pass drilling fluid therethrough, ports within the bypass sub will open and allow drilling fluid (or another fluid) circulation at least to the longitudinal position of the bypass sub. Such a configuration may provide a mechanism to retain fluid circulation capability along a substantial portion of a drill string in the event that a deleterious event prevents flow through an expandable reamer of the present invention.

It may be further appreciated that actuation sleeve 40, fixed sleeve 39, and guide sleeve 60 may be omitted from the bore 31 of expandable reamer 10. Accordingly, bore 31 may comprise an open bore extending through upper and lower tubular body sections 32A and 32B. However, protection elements (not shown), such as covers may be positioned within bore 31 for preventing wear to threads or other features within the bore 31 of expandable reamer 10. In such a configuration, drilling fluid will constantly act against the movable blades 12 and 14. Accordingly, blade-biasing elements 24, 26, 28, and 30 may be configured for substantially biasing or holding movable blades 12 and 14 laterally inwardly for drilling fluid flow rates (which relate to pressures of drilling fluid acting on movable blades 12 and 14) that may be desirable without expanding movable blades 12 and 14 laterally outwardly for reaming.

Turning to aspects related to at least one movable blade of an expandable reamer of the present invention, with respect to a blade-biasing element (e.g., any of blade-biasing elements 24, 26, 28, and 30 as shown in FIGS. 1A, 1B, and 1E), the present invention contemplates many alternatives. For instance, a blade-biasing element may comprise at least one of a Belleville spring, a wave spring, a washer-type spring, a leaf spring, and a coil spring (e.g., comprising square wire, cylindrical wire, or otherwise shaped wire). Further, a blade-biasing element may comprise any material having a suitable strength and desired elasticity. For instance, in one embodiment, at least one of blade-biasing elements 24, 26, 28, and 30, as shown in FIG. 1A, may comprise at least one of steel, music wire, and titanium. However, the present invention contemplates that any material with a relatively high modulus of elasticity may be utilized for forming a blade-biasing element, without limitation.

Figure 2A:
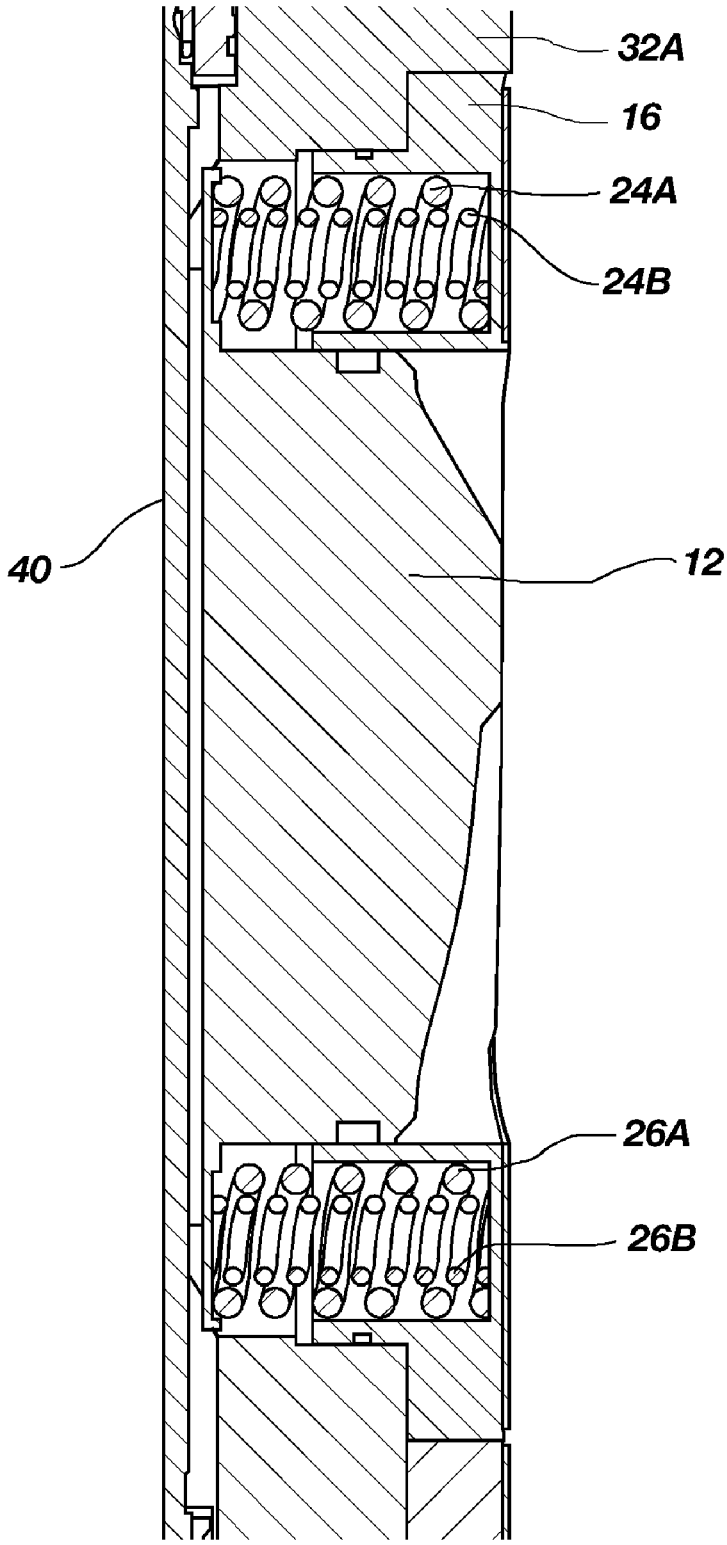
FIG. 2A is an enlarged, partial cross-sectional view of a movable blade of an expandable reamer of the present invention including a nested configuration of blade-biasing elements.

In another aspect of the present invention, a plurality of blade-biasing elements may be arranged in a so-called "nested" configuration for biasing a portion of a movable blade. Particularly, as shown in FIG. 2A, blade-biasing elements 24A and 24B may be positioned within one another and within an upper end of retention element 16 for biasing movable blade 12. Also, blade-biasing elements 26A and 26B may be positioned within one another and within a lower end of retention element 16 for biasing movable blade 12. Such an arrangement may provide additional force for returning movable blade 12 toward the center of the expandable reamer 10 compared to blade-biasing element 26A alone. Further, each of blade-biasing elements 24A and 24B may be wound in opposite helical directions. Such a configuration may inhibit interference (e.g., coils of one of the blade-biasing elements 24A and 24B becoming interposed between coils of the other of the blade-biasing elements 24A and 24B) between the blade-biasing elements 24A and 24B.

Figure 2B:
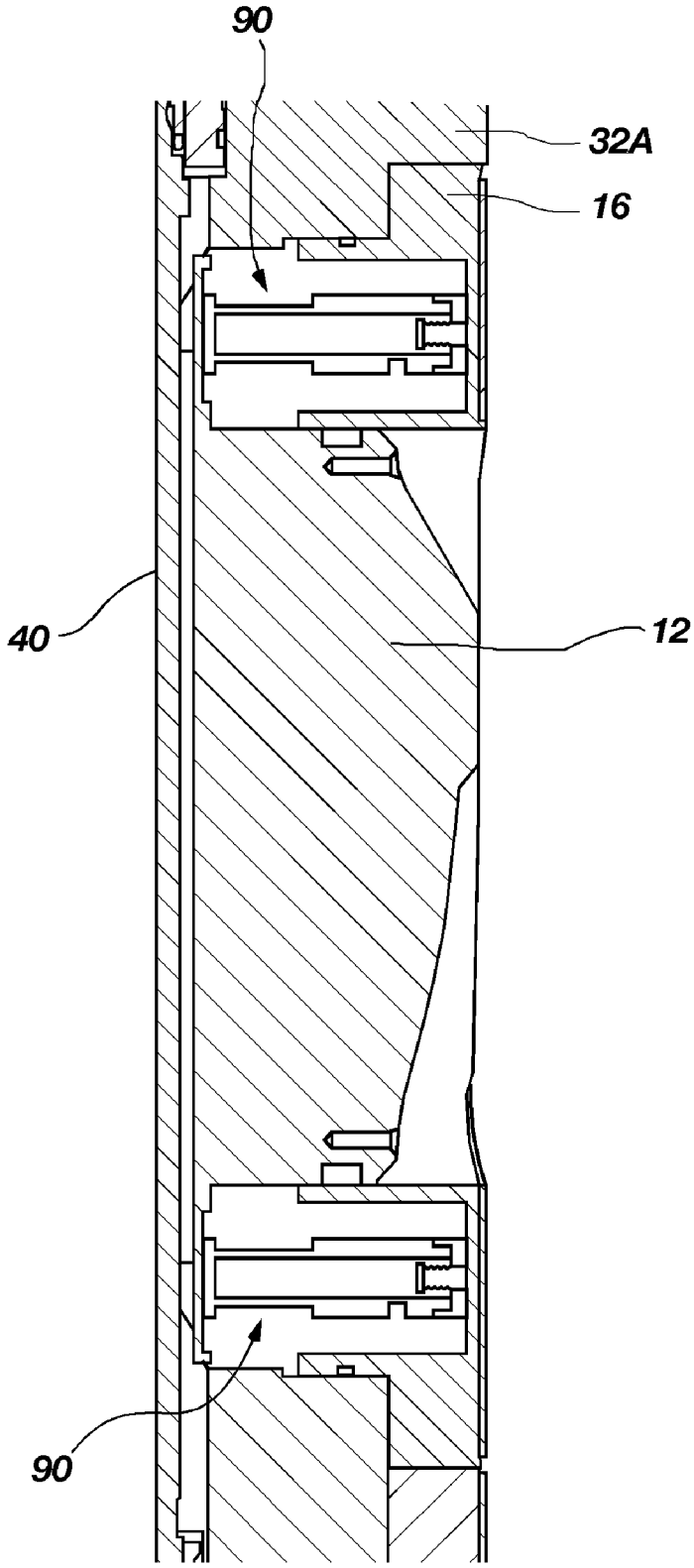
FIG. 2B is an enlarged, partial cross-sectional view of a movable blade of an expandable reamer of the present invention including two blade motion-dampening members.
Figure 2C:
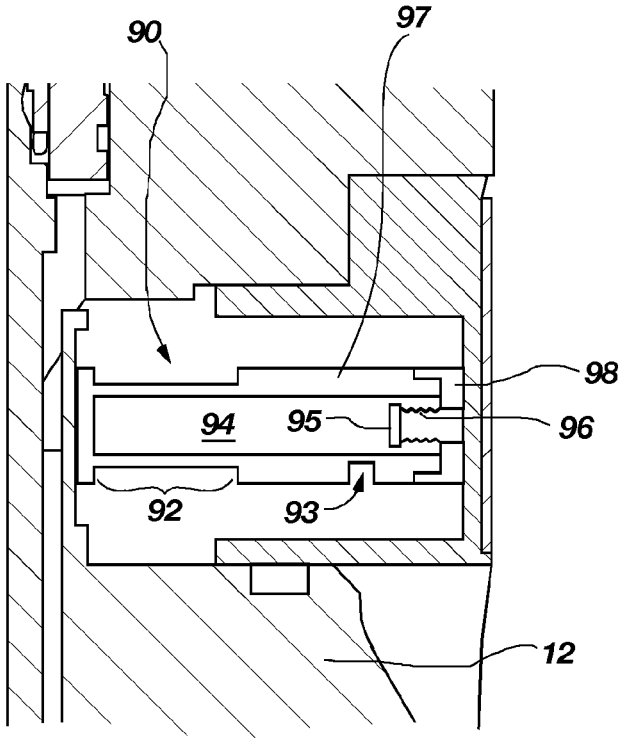
FIG. 2C is an enlarged, partial cross-sectional view of a dampening member as shown in FIG. 2B.

Optionally, in another aspect of the present invention related to a movable blade, at least one dampening member (e.g., a viscous damper or frictional damper) may be configured for limiting a rate of laterally outward displacement of at least one movable blade of an expandable reamer. For instance, FIG. 2B shows an enlarged side cross-sectional view of movable blade 12 wherein dampening members 90 are positioned proximate each of the longitudinal ends of movable blade 12, between retention element 16 and movable blade 12. Dampening members 90 may be positioned within an interior or proximate (e.g., alongside) blade-biasing elements (blade-biasing elements 24 and 26 as shown in FIGS. 1A, 1B and 1E are not shown in FIG. 2B, for clarity) positioned between movable blade 12 and retention element 16. More specifically, as shown in FIG. 2C, which shows an enlarged view of a region of expandable reamer 10 proximate the upper end of movable blade 12, dampening member 90 may comprise a body 97 having a crushable region 92, the body 97 also attached to a cap 98 having a bellows 96 and a movable element 95. Body 97, in combination with cap 98, bellows 96, and movable element 95, define a chamber 94 of dampening member 90. Bellows 96 and movable element 95 may be configured for substantially equalizing the pressure between the chamber 94 and a pressure exterior thereto (e.g., pressure of drilling fluid). Such a structure may be known as a "compensator." Chamber 94 may be filled with a fluid, such as, for instance, oil, water, or another fluid. Further, dampening member 90 may include a frangible port 93 that is structured for failing or otherwise allowing fluid within chamber 94 of dampening member 90 to be expelled or passed therethrough in response to movable blade 12 matingly engaging and crushing crushable region 92.

Thus, during operation, as movable blade 12 is forced toward retention element 16, movable element 95 may be forced against cap 98. Thus, a contact force may be developed between the movable blade 12 and the dampening member 90. In turn, pressure may build within chamber 94 to a magnitude sufficient, by way of crushing of crushable region 92, so as to fail frangible port 93 and cause fluid to be expelled from the chamber 94. Accordingly, the relative speed at which movable blade 12 may move toward retention element 16 may be tempered or limited by the relationship between the pressure within the chamber 94 and the rate at which fluid is expelled from the frangible port 93. Optionally, crushable region 92 may be structured for collapsing into an interior (i.e., chamber 94) of body 97 of dampening member 90. Such a configuration may be advantageous for avoiding interference with a blade-biasing element (not shown) proximate to the dampening member 90.

Figure 2D:
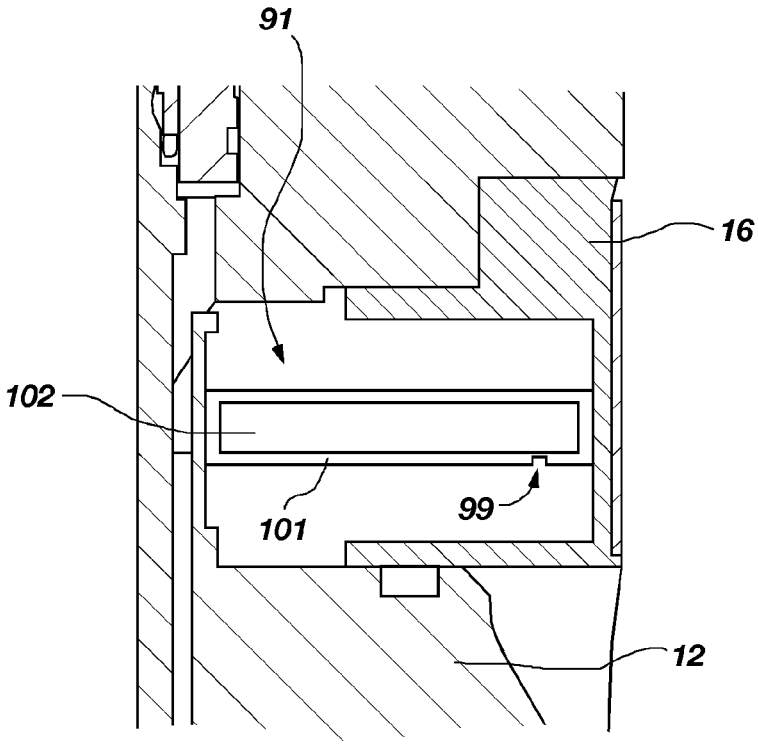
FIG. 2D is an enlarged, partial cross-sectional view of an alternative embodiment of a dampening member.

Alternatively, as shown in FIG. 2D, which shows a schematic side cross-sectional view of movable blade 12, a dampening member 91 may comprise a body 101 forming a chamber 102 substantially filled with a fluid (e.g., oil, water, etc.) and having at least one frangible or preferentially weakened port 99. Dampening members 91 may be positioned within an interior or proximate (e.g., alongside) blade-biasing elements (blade-biasing elements 24 and 26 as shown in FIGS. 1A, 1B and 1E are not shown in FIG. 2D, for clarity) positioned between each of the longitudinal ends of movable blade 12. Such a configuration may cause, subsequent to a selected contact force between the movable blade 12 and the dampening member 91 and during movement of movable blade 12 laterally outwardly, the fluid within chamber 102 of body 101 to be expelled therefrom. Thus, the size of the at least one port 99, as well as the properties of the fluid (e.g., viscosity, density, etc.), may substantially limit the rate at which the fluid may be expelled therefrom. In turn, movable blade 12 may be displaced laterally outwardly at a substantially limited rate in relation to the rate at which fluid is expelled from the at least one port 99. Of course, the body 101 may be substantially crushed or compressed as the movable blade 12 is displaced toward retention element 16 and may also be structured therefor. Further, dampening member 91 may be structured for avoiding interference with a blade-biasing element proximate to the dampening member 90. Thus, dampening member 91 may not substantially influence positioning of movable blade 12 against retention element 16, other than limiting a lateral speed of movable blade 12 toward retention element 16.

Figure 3B:
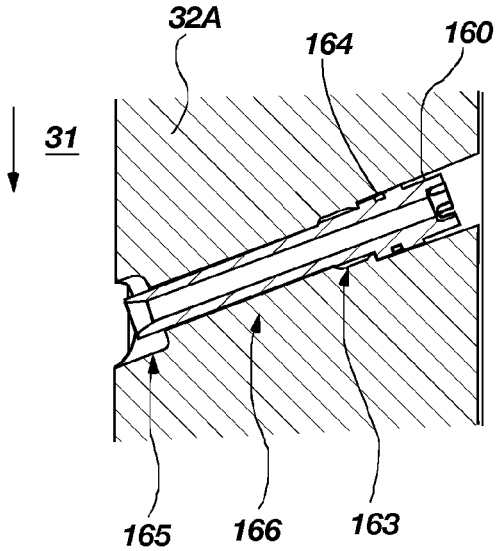
FIG. 3B is an enlarged partial cross-sectional view of the fluid aperture shown in FIG. 3A.
Figure 3A:
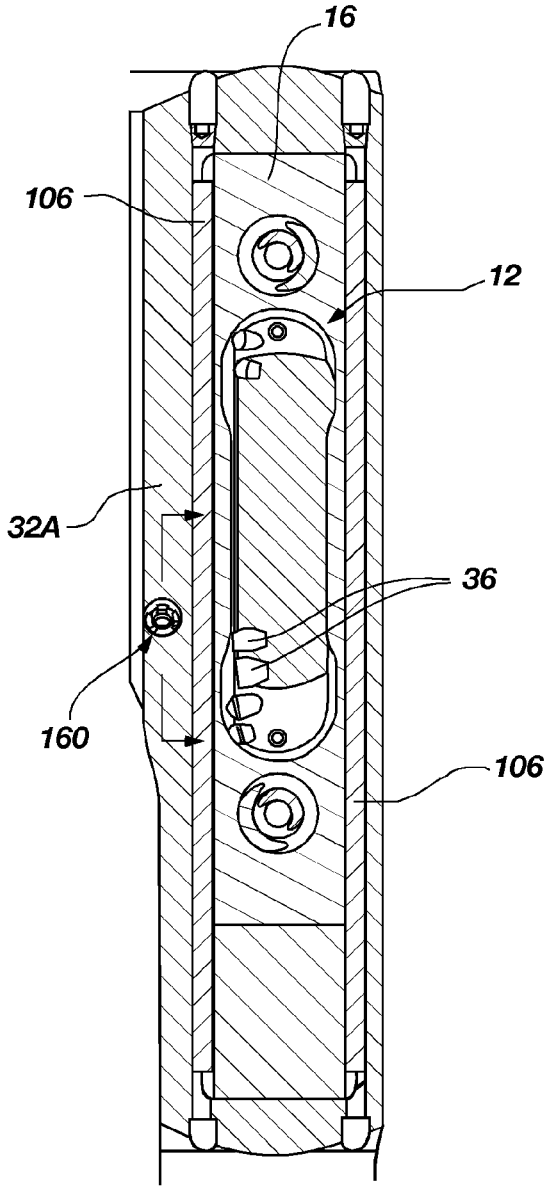
FIG. 3A is a conceptual partially cross-sectioned side view of a movable blade of an expandable reamer of the present invention including a fluid aperture proximate thereto.

In a further aspect of the present invention, an aperture or port configured for conducting drilling fluid for facilitating cleaning of the formation cuttings from the cutting elements 36 affixed to at least one movable blade of the expandable reamer during reaming. In one embodiment, as shown in FIGS. 3A and 3B, an aperture 166 may extend from the bore 31 of upper tubular body section 32A to an exterior surface thereof, structured for delivering drilling fluid in a direction generally toward cutting elements 36 on a movable blade 12. Aperture 166 may include an oversized inlet region 165 and a threaded surface 163 for mating with a nozzle 160 configured for communicating fluid from an interior of the upper tubular body section 32A to an exterior surface thereof. The interior of the upper tubular body section 32A adjacent to the nozzle 160 may also be counterbored or recessed around an inlet to nozzle 160 for the purpose of preventing erosion to upper tubular body section 32A. Nozzle 160 may also include a groove for carrying a sealing element 164 positioned between the upper tubular body section 32A and the nozzle 160. Further, aperture 166 may be oriented at an angle toward the upper or lower longitudinal end of the expandable reamer 10. Alternatively, an aperture 166 may be installed in the horizontal direction, (i.e., substantially perpendicular to a longitudinal axis) through tubular body 32 of the expandable reamer 10. Of course, the present invention contemplates that an aperture 166 may be oriented as desired. Other configurations for communicating fluid from the interior of the tubular body 32 to the cutting elements 36 carried by a movable blade are contemplated, including a plurality of apertures proximate or extending through at least one movable blade of expandable reamer 10. Alternatively, at least one of movable blades (e.g., movable blade 12, movable blade 14, or other movable blades) of the expandable reamer 10 may be configured with an aperture 166, as described above, extending therethrough.

In a further aspect of the present invention related to drilling fluid, it may be advantageous to configure the space between the movable blades of an expandable reamer for facilitating nozzle placement and drilling fluid flow. Explaining further, a (circumferential) gap or space between blades of a drill bit or a reamer is commonly termed a "junk slot." According to the present invention, a junk slot defined between two movable blades of an expandable reamer may be tapered or exhibit a varying size so that an area or width (shown in FIG. 3C as "w") between the movable blades increases or decreases along a longitudinal direction. Alternatively, a size (e.g., an area or width) of a junk slot between the movable blades may, be stepped or otherwise sequentially vary (i.e., increase or decrease or vice versa) in the direction of drilling fluid flow.

Figure 3C:
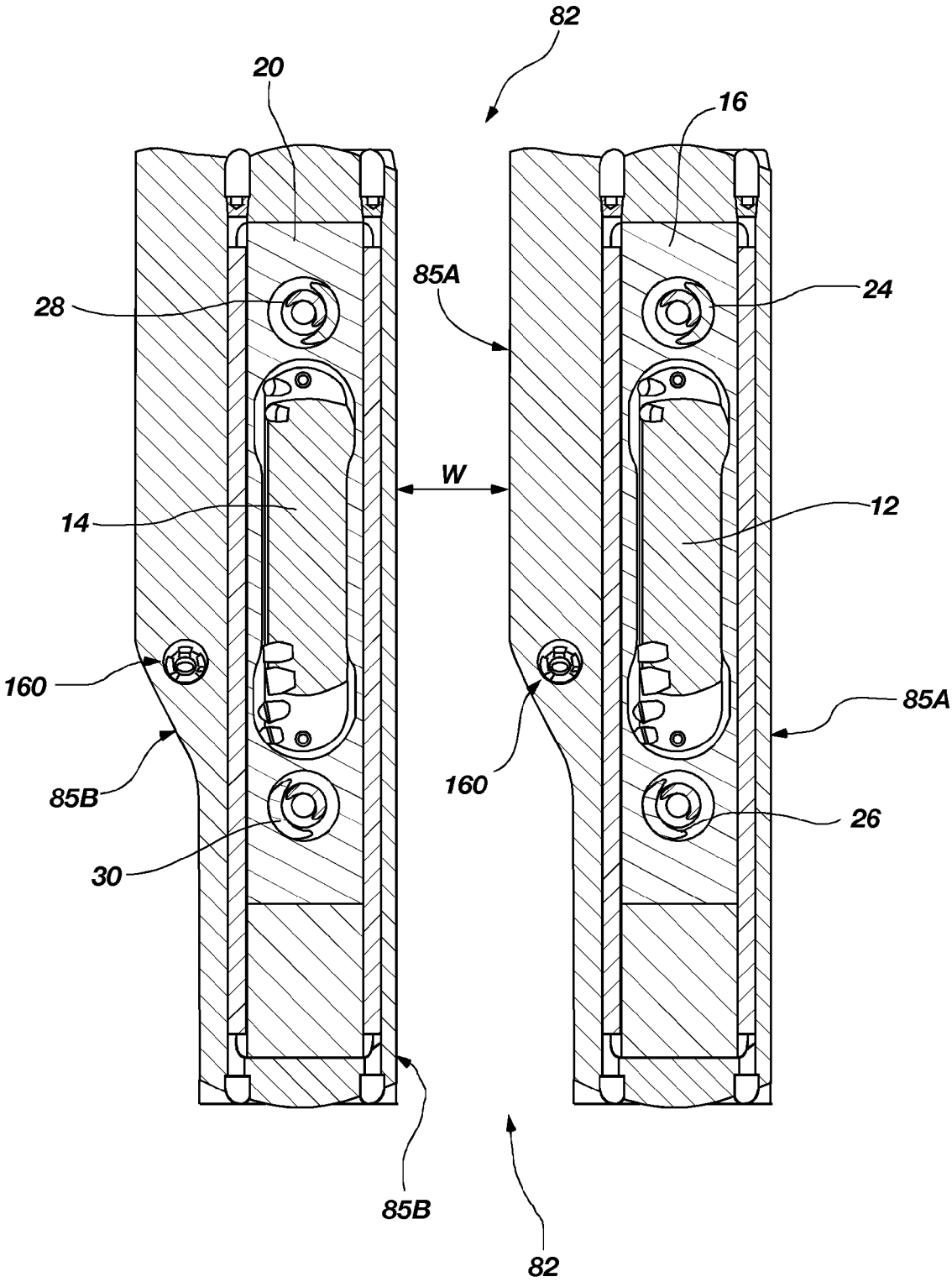
FIG. 3C is a schematic partially cross-sectioned side view of two movable blades shown as if they were unrolled from the circumference of the drill bit and positioned upon a substantially planar surface.

In one example, as shown in FIG. 3C, movable blades 12 and 14 are shown in a partially cross-sectioned side view, as if they were unrolled from the circumference of the drill bit and positioned upon a substantially planar surface. Such a view is merely a representation to better illustrate the longitudinal geometry of junk slot 82 (also shown in FIGS. 4A and 4B). Particularly, junk slot 82 may be defined between blade bases 85A and 85B (also shown in FIGS. 4A and 4B), as well as movable blades 12 and 14. (As shown in FIG. 4C, blade bases 85A and 85B may be circumferential extensions of tubular body 32 (not shown).) Further, as shown in FIG. 3C, blade bases 85A and 85B may be shaped longitudinally so as to form a junk slot 82 that exhibits a generally decreasing size or area as a function of an upwardly increasing longitudinal position. Such a configuration may provide additional capability for placement of at least one nozzle 160 proximate the lower longitudinal end of movable blades 12 and 14 and may promote desirable flow characteristics of drilling fluid therefrom.

An expandable reamer according to the present invention may include at least one movable blade or, alternatively, a plurality of movable blades. In addition, if a plurality of movable blades is carried by an expandable reamer, the plurality of movable blades may be symmetrically circumferentially arranged about a longitudinal axis of the expandable reamer or, alternatively, nonsymmetrically circumferentially arranged about a longitudinal axis of the expandable reamer.

Figure 4A:
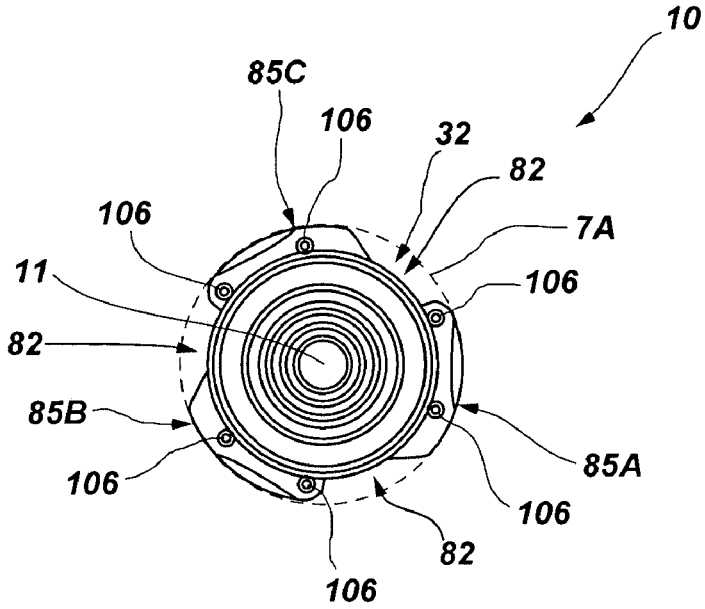
FIGS. 4A and 4B are conceptual top elevation views of the expandable reamer shown in FIGS. 1A-1E of the present invention in a contracted state and an expanded state respectively.
Figure 4B:
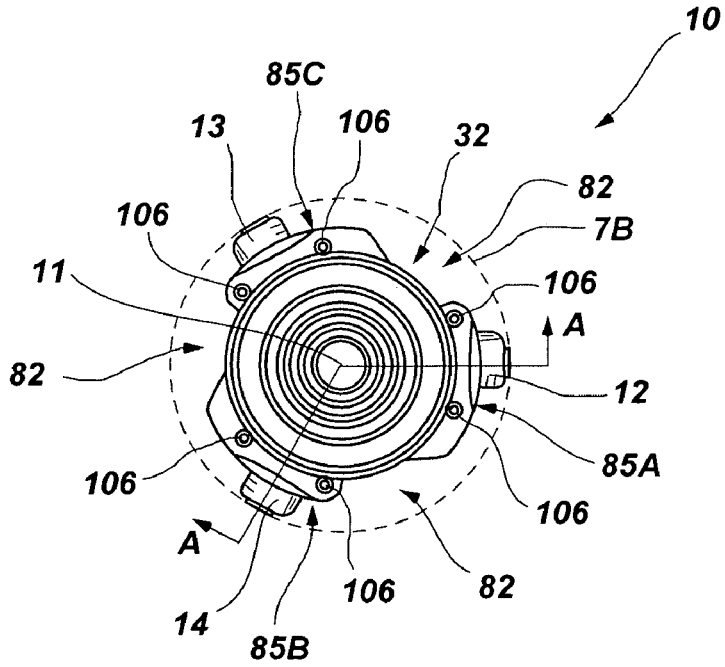
Figure 4C:
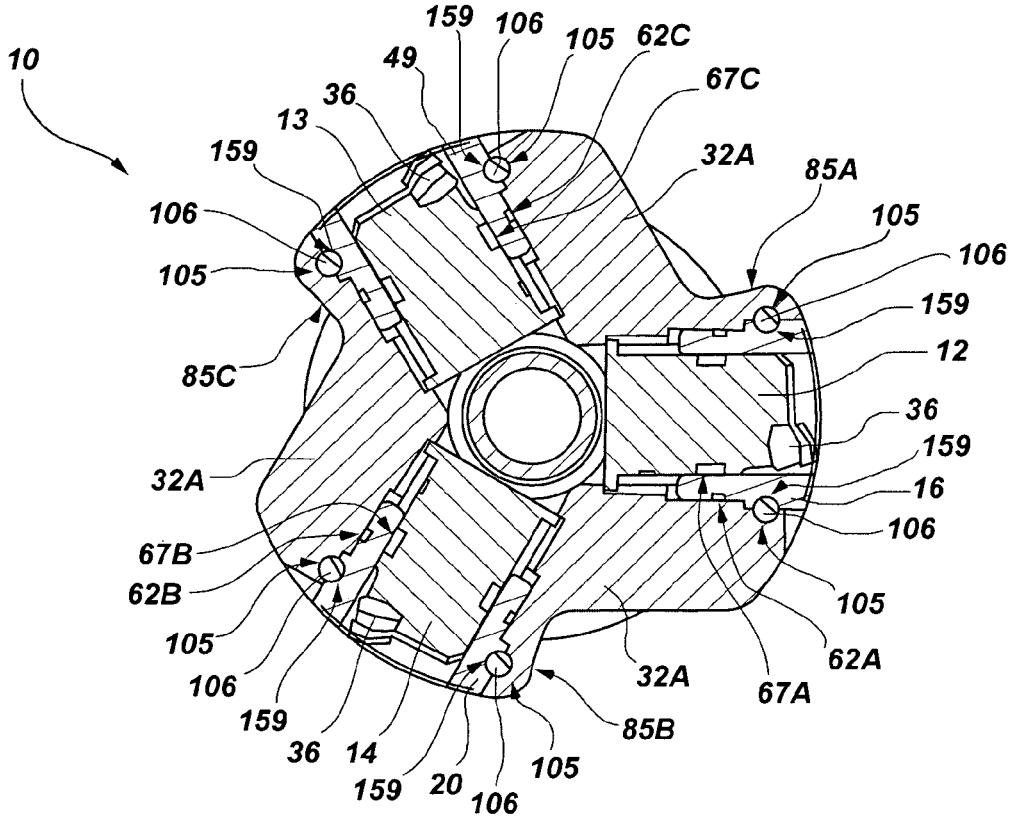
FIG. 4C is a cross-sectional bottom elevation view taken through movable blades of an expandable reamer as shown in FIGS. 1A-1E.

For completeness, FIGS. 4A-4C each show a conceptual top elevation view of one embodiment of expandable reamer 10, wherein expandable reamer 10 includes symmetrically circumferentially arranged blade bases 85A-85C including movable blades 12, 13, and 14 therein. Further, movable blades 12, 13, and 14 of expandable reamer 10 may be caused to expand from a laterally innermost position corresponding to boundary circle 7A to an outermost lateral position defined by boundary circle 7B and the borehole may be enlarged by the combination of rotation and longitudinal displacement of the expandable reamer 10. Accordingly, each movable blade 12 of an expandable reamer may be positioned circumferentially as desired in relation to one another. Also, FIG. 4B illustrates that each of the side cross-sectional views as shown in FIGS. 1A-1E may be taken along reference line A-A, comprising two line segments extending from longitudinal axis 11, the side cross-sectional views as are shown in FIGS. 1A-1E being substantially perpendicular to each line segment of reference line A-A.

Also, as shown in FIGS. 4A-4C, movable blades 12, 13, and 14 may be retained within expandable reamer 10 by removable lock rods 106 extending longitudinally along the upper tubular body section 32A of the expandable reamer 10 on sides of movable blade 12, 13, and 14, respectively. Additionally, as shown in FIG. 4C, removable lock rods 106 may at least partially extend along recesses 159 formed in retention elements 16, 20, and 49 and proximately positioned cooperatively shaped recesses 105 formed in upper tubular body section 32A. Further, each of lock rods 106 may be captured or otherwise affixed at longitudinal upper and lower ends (not shown) thereof within a hole (not shown) extending into upper tubular body section 32A substantially aligned therewith. Of course, lock rods 106 may be affixed to upper tubular body section 32A by welding, splines, pins, combinations thereof, or otherwise affixing lock rods 106 thereto. Alternatively, lock rods 106 may be positioned within holes formed within upper tubular body section 32A and a removable plug (threaded, pinned, or otherwise affixed to upper tubular body section 32A) may be placed within an end of at least one of the holes. Thus, affixing both longitudinal ends of lock rods 106 to upper tubular body section 32A also affixes, by extending longitudinally along the exterior within recesses 105 and 159, retention element 16 to upper tubular body section 32A and movable blades 12, 14, and 13 therein. Put another way, recesses 105 and 159 formed in the retention elements 16, 20, and 49 and upper tubular body 32A, respectively, and extensions of such recesses (formed as holes) into upper tubular body 32A in the regions 33A, 33B, 35A, and 35B, as shown in FIGS. 1A-1C, may allow for removable lock rods 106 to be inserted therethrough, extending between retention elements 16, 20, and 49 and upper tubular body section 32A, thus affixing retention elements 16, 20, and 49 to upper tubular body 32A. When fully installed, removable lock rods 106 may extend substantially the length of retention elements 16, 20, and 49, respectively, but may extend further, depending on how the removable lock rods 106 are affixed to the upper tubular body 32A. Of course, optionally, removable lock rods 106 may be detached from the upper tubular body section 32A to allow for removal of retention elements 16, 20, and 49 as well as movable blades 12, 14, and 13, respectively, therefrom. Accordingly, the present invention contemplates that a retention element 16, 20, or 49, a movable blade 12, 14, or 13 or both, of expandable reamer 10 may be removed, replaced, or repaired by way of removing the removable lock rods 106 from the recesses 105 and 159 formed in retention elements 16, 20, and 49 and upper tubular body section 32A, respectively. Of course, many alternative removable retention configurations are possible including pinned elements, threaded elements, dovetail elements, or other connection elements known in the art to retain a movable blade. Also depicted in FIG. 4C are peripheral sealing elements 67A, 67B, 67C, 62A, 62B, and 62C carried in respective grooves formed into the exterior of blades 12, 14, and 13, and retention elements 16, 20, and 49, respectively, which may be configured for preventing debris and contaminants from the wellbore from entering the interior of expandable reamer 10 and may also maintain a relatively higher pressure within the expandable reamer 10, as compared to a pressure experienced upon an exterior of the expandable reamer 10.

The present invention also contemplates that cutting elements 36 may be positioned on a movable blade of the expandable reamer 10 so as to be circumferentially and rotationally offset from an outer, rotationally leading edge portion of a movable blade where a rotationally leading contact point is likely to occur. Such positioning of the cutting elements rotationally, or circumferentially, to a position rotationally following the casing contact point located on the radially outermost leading edge of a movable blade may allow the cutters to remain on proper drill diameter for enlarging the borehole, but are, in effect, recessed or protected from the rotationally leading contact point. Such an arrangement is disclosed and claimed in U.S. Pat. No. 6,695,080 to Presley et al., assigned to the assignee of the present invention, the disclosure of which is incorporated herein in its entirety by this reference.

Figure 4D:
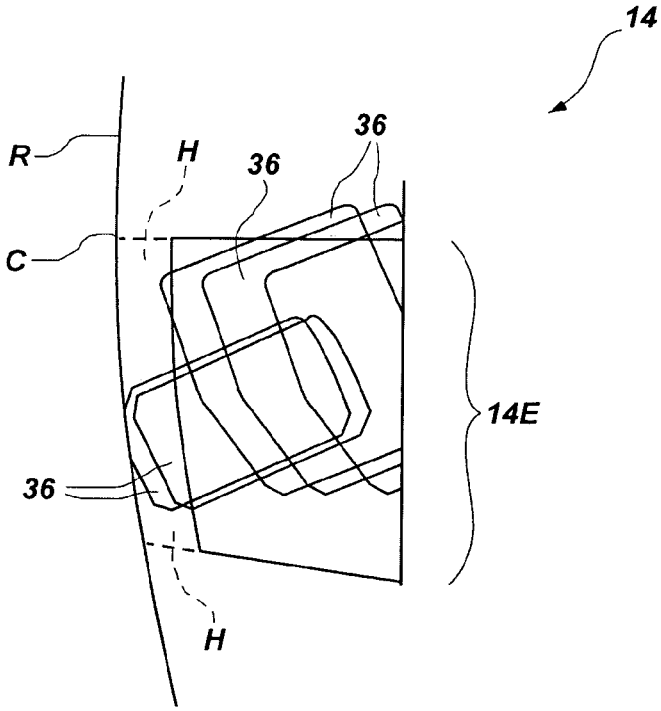
FIG. 4D is a partial bottom elevation view of an end region of a movable blade showing cutting element positions thereon.

In further detail, FIG. 4D illustrates a top elevation view of a radial end region 14E of movable blade 14 having cutting elements 36 disposed thereon. The radial end region 14E of movable blade 14 may include hardfacing H extending out to reaming diameter R (also showing direction of reaming). Thus, hardfacing H may provide a bearing surface for the gage while a formation is being reamed. In addition, the hardfacing H may protect the cutting elements 36, which are circumferentially rotated toward the back of movable blade 14 and away from initial circumferential contact point C. Such a configuration may substantially inhibit contact between the cutting elements 36 and a formation, a casing, or another stricture to be reamed. In addition, superabrasive, specifically diamond inserts (e.g., hemispherical superabrasive inserts, BRUTE™ PDC elements, etc.), may be appropriately placed proximate cutting elements 36. Such a configuration may provide additional protection for cutting elements 36.

Figure 5C:
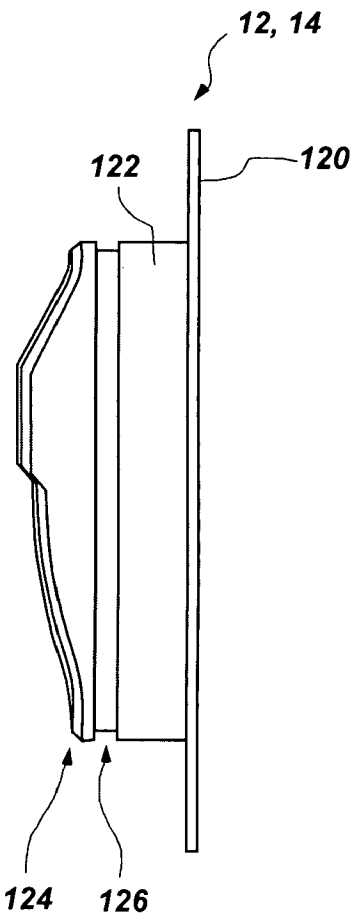
FIG. 5C is a back view of the movable blade as shown in FIG. 5A.
Figure 5B:
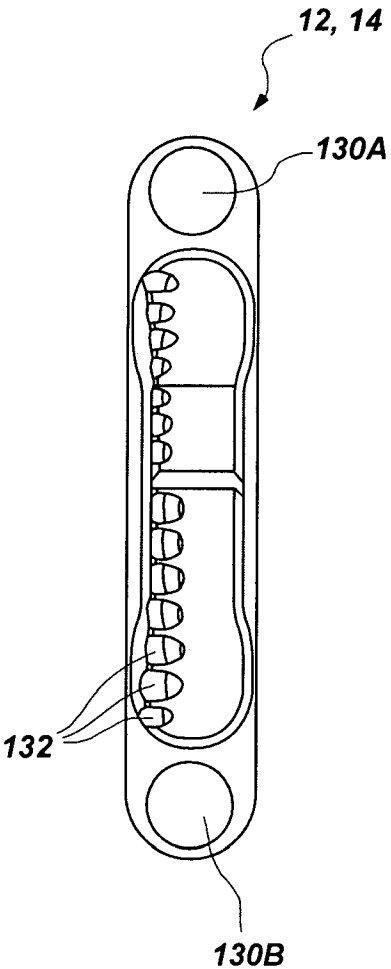
FIG. 5B is a side view of the movable blade as shown in FIG. 5A.

For further exploring aspects of the present invention, a movable blade is described in additional detail as follows. Specifically, FIGS. 5A-5C show movable blade 12, 14 as shown in FIGS. 1A, 1B, and 1E. FIG. 5A shows a side front view of movable blade 12, 14, wherein the cutting elements (not shown) facing toward the viewer (i.e., positioned as blade 12 is positioned in FIG. 1B). Movable blade 12, 14 includes cutting element pockets 132 disposed along a so-called profile 128, as discussed in more detail hereinbelow. FIG. 5B shows a side view of movable blade 12, 14 and shows depressions 130A and 130B, which may be configured for engaging and facilitating positioning of an end of a blade-biasing element (not shown) engaged therewith, as shown in FIGS. 1A and 1E. FIG. 5C shows a side back view of movable blade 12, 14, wherein the cutting elements (not shown) face away from the viewer (i.e., positioned as blade 14 is positioned in FIG. 1B). Movable blade 12, 14 may further include a base plate 120, a piston body 122 extending therefrom, a groove 126 and cutting element pockets 132 sized and configured for placement of cutting elements (not shown) therein. Further, a tapered shoulder periphery 124 may extend about the periphery of the movable blade 12, 14. Angle θ between axis X to axis Z is discussed in further detail hereinbelow.

Figure 5D:
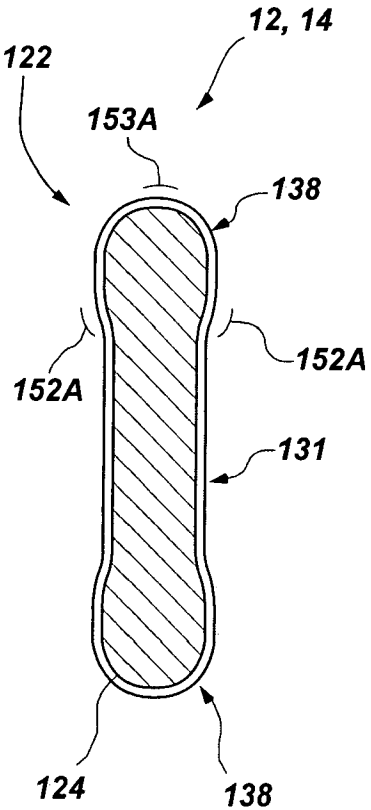
FIG. 5D is a cross-sectional view of the movable blade as shown in FIG. 5A, taken through the piston body thereof.
Figure 5A:
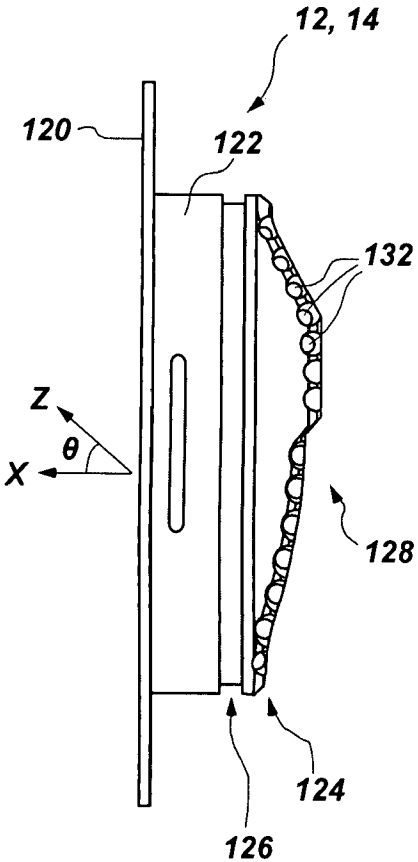
FIG. 5A is a front view of a movable blade.

FIG. 5D shows a cross-sectional view taken through piston body 122. As shown in FIG. 5D, piston body 122 may exhibit a so-called "dog-bone" geometry. Particularly, a cross-sectional shape of the piston body 122 may comprise two enlarged ends 138 connected to one another via a substantially constant body 131 portion of relatively smaller dimension extending therebetween.

Figures 1, 5E:
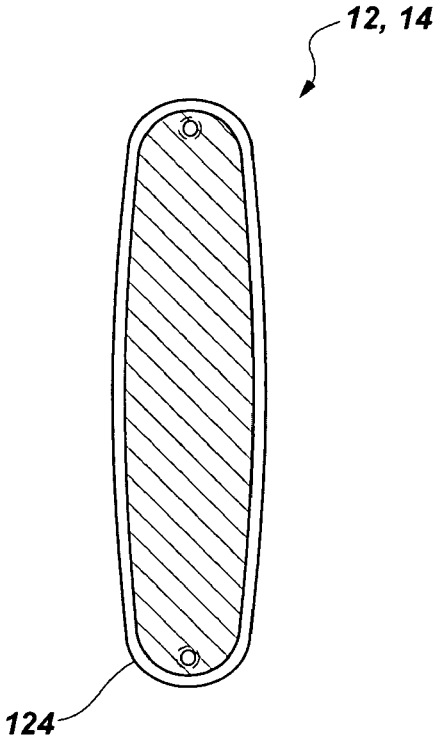
FIG. 5E-1 is a cross-sectional view of an alternative embodiment of a movable blade as shown in FIG. 5A, taken through the piston body thereof.
Figures 2, 5E:
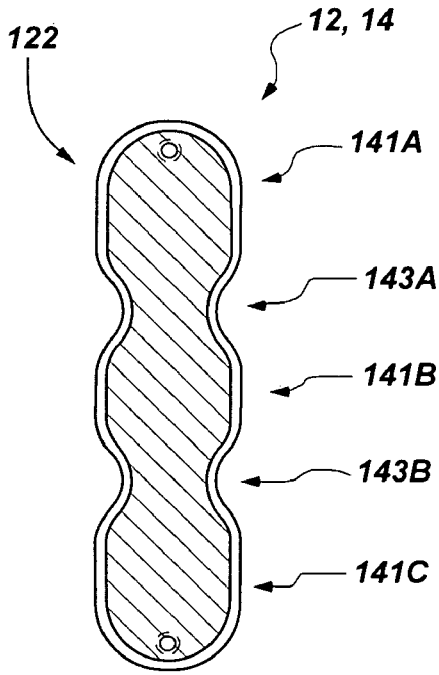

In another embodiment, a movable blade 12, 14 may be configured as shown in FIGS. 5A and 5C, but may have a substantially oval or elliptical cross-section as shown in FIG. 5E-1 (as opposed to FIG. 5D). Further, the cross-section of a movable blade 12, 14 need not be symmetrical or, alternatively, may be symmetrical if desired. In yet a further example, advantages of which are described in greater detail hereinbelow, a movable blade 12, 14 may have a so-called "tri-lobe" cross-section as shown in 5E-2. Particularly, "tri-lobe" refers to a cross section of piston body 122 comprising three alternating enlarged regions 141A, 141B, and 141C, separated by necked regions 143A and 143B, as shown in FIG. 5E-2.

Figures 1, 5F:
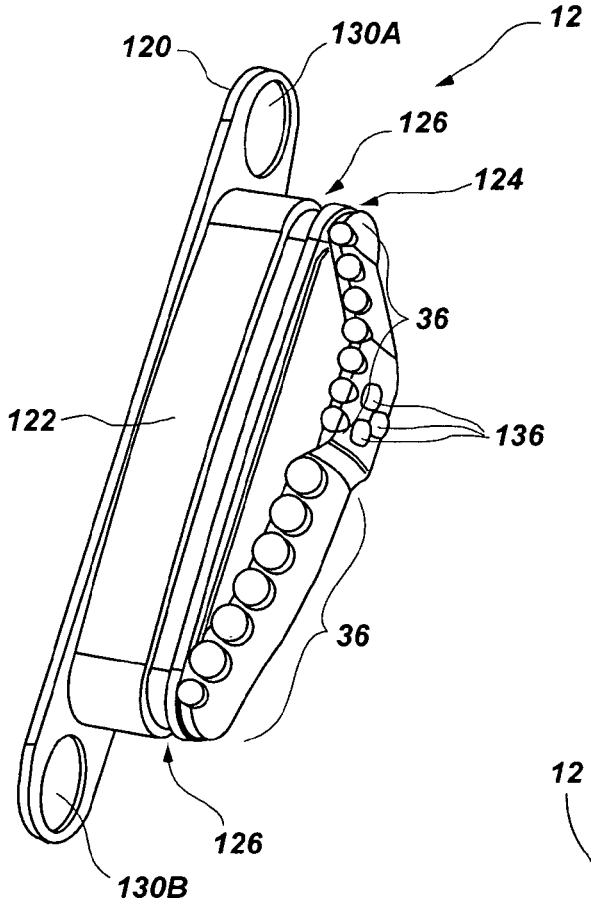
Figures 2, 5F:
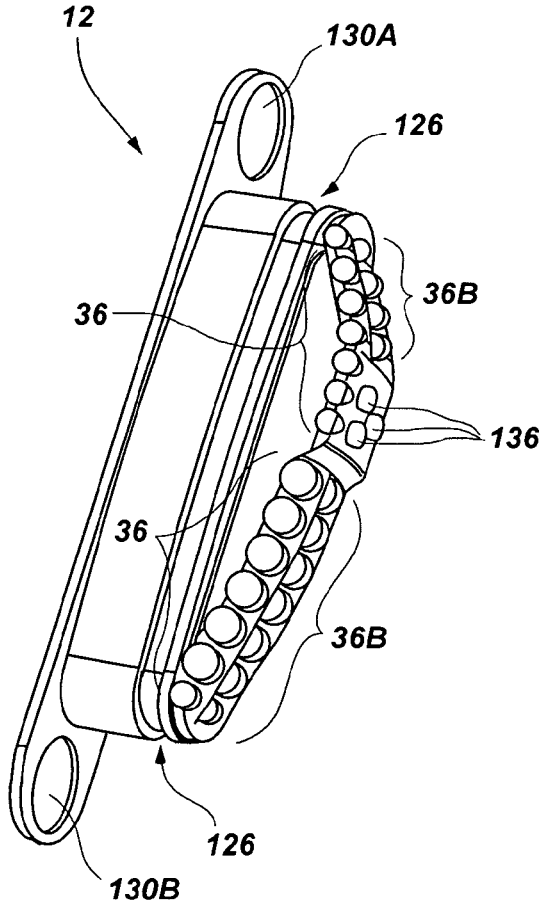

FIG. 5F-1 shows a movable blade 12 having a generally oval piston body 122, as shown in FIG. 5E-1, in a perspective view. As a further contemplation of the present invention, a movable blade may include so-called "BRUTE™" PDC cutters. Such BRUTE™ PDC cutters are described in U.S. Pat. No. 6,408,958 to Isbell, et al., assigned to the assignee of the present invention, the disclosure of which is incorporated herein in its entirety by this reference, which discloses a cutting assembly that may be employed upon an expandable reamer of the present invention. More specifically, an expandable reamer of the present invention may include a cutting assembly comprised of first and second superabrasive cutting elements including at least one rotationally leading cutting element having a cutting face oriented generally in a direction of intended rotation of a bit on which the assembly is mounted to cut a subterranean formation with a cutting edge at an outer periphery of the cutting face, and a rotationally trailing cutting element oriented substantially transverse to the direction of intended bit rotation and including a relatively thick superabrasive table configured to cut the formation with a cutting edge located between a beveled surface at the side of the superabrasive table and an end face thereof.

For example, as shown in FIGS. 5F-1, cutting elements 136 may be positioned so as to exhibit a substantially planar surface that is oriented substantially parallel to the direction of cutting of rotationally preceding cutting elements 36. Such a configuration may be advantageous for limiting the depth of cut of the rotationally preceding cutting elements 36. Cutting elements 136 are shown as being positioned within a gage region of movable blade 12, which may be advantageous for maintaining the overall diameter of an expandable reamer during use. However, the present invention contemplates that cutting elements 136 may be positioned upon a movable blade or generally upon an expandable reamer of the present invention as desired for resisting wear, limiting engagement (e.g., depth of cut) with a subterranean formation, or both.

Optionally, a so-called "backup" row of cutting elements may be positioned upon a movable blade rotationally following a leading row of cutting elements positioned thereon. For example, FIGS. 5F-2 shows a perspective view of movable blade 12 as shown in FIGS. 5F-1, but including cutting elements 36B, which are arranged in a backup row rotationally following cutting elements 36. Cutting elements 36B may be sized and positioned in any manner desired, as known in the art. Further, although the row of cutting elements 36B is shown as exhibiting substantially similar size and configuration in relation to the row of cutting elements 36, the present invention contemplates that a backup row of cutting elements may be employed as desired, without limitation. Put another way, a backup row may comprise at least one cutting element generally rotationally following at least one cutting element. Of course, generally rotationally following at least one cutting element may be generally aligned with a preceding cutting element or may be misaligned with respect thereto, without limitation. Such a configuration may provide additional available cutting element functionality (e.g., coverage, material, force balancing, or redundancy) as compared to cutting elements 36 alone.

Figure 5G:
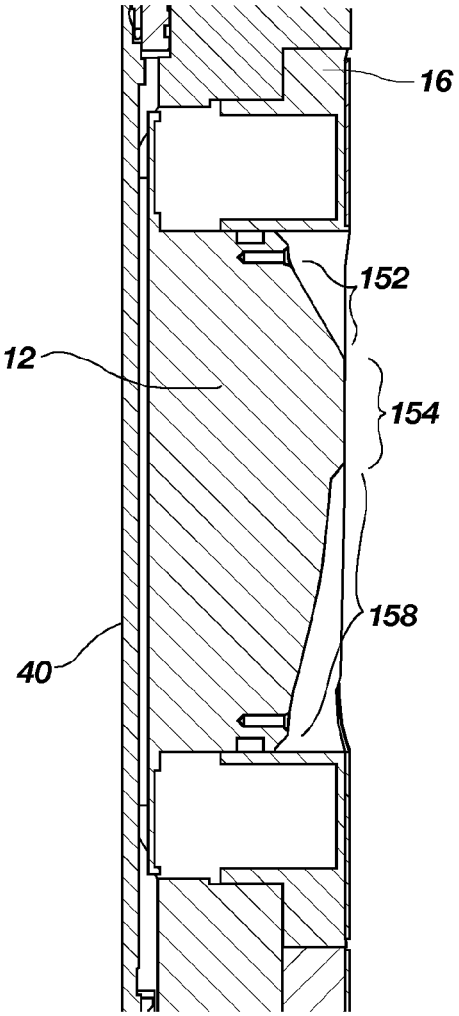
FIG. 5G is a conceptual side cross-sectional view of a movable blade profile according to the present invention.

With respect to a movable blade configuration, it should be understood that, generally, an expandable reamer of the present invention may be operated so as to ream a subterranean formation or other structure in at least one of a longitudinally upward and downward direction (i.e., also known as "up-drilling," "up-reaming," or "down-reaming"). Accordingly, it may be desirable to configure the profile of a movable blade accordingly. As used herein, "profile" refers generally to a reference line upon which each of the cutting elements is placed or lie. Generally, a blade profile may follow an outer lateral outline or blade shape. For instance, as shown in FIG. 5G, movable blade 12 may include three profile regions 152, 154, and 158. Such a configuration may be desirable for predominantly reaming with profile region 158 in a longitudinally downward direction. Profile region 158 may generally exhibit a parabolic or exponential (e.g., radial position as a function of longitudinal position) shape. Such a configuration may be relatively durable with respect to withstanding reaming of a subterranean formation. Of course, the present invention contemplates that any geometry (linear, angled, arcuate, etc.) may be selected for any of profile regions 152, 154, and 158, without limitation. Profile region 154 is also known as a gage region, which corresponds (upon expansion of movable blade 12) with an outermost diameter of the expandable reamer. Further, profile region 152, shown as being angled or tapered (e.g., oriented at 20° or another angle greater or less than 20°, without limitation) with respect to a longitudinal axis of an expandable reamer, may be configured with cutting elements (not shown) for up-drilling or up-reaming (i.e., reaming in an upward longitudinal direction). Also, profile region 152 may facilitate movable blade 12 returning laterally inwardly during tripping out of a subterranean borehole. Specifically, impacts between the borehole and the profile region 152 may tend to move the movable blade 12 laterally inward.

Figure 5H:
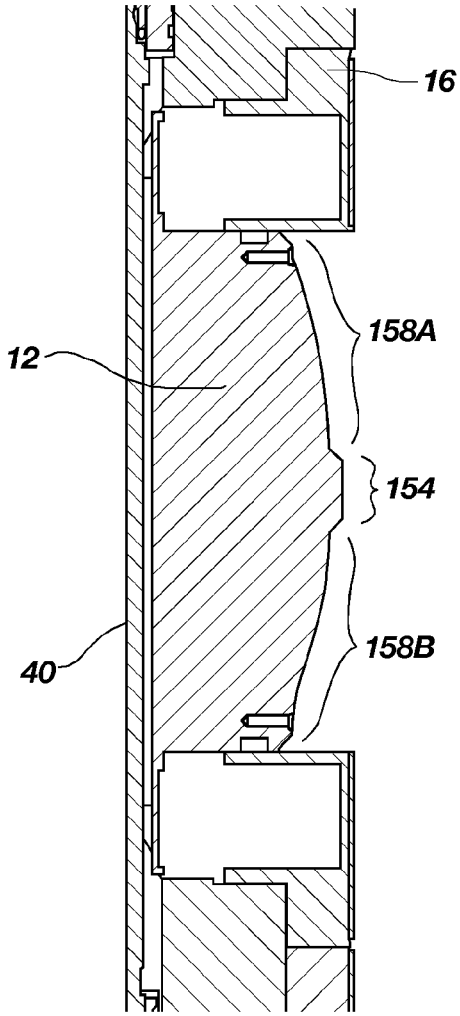
FIG. 5H is a conceptual side cross-sectional view of an alternative embodiment of a moveable blade profile according to the present invention.

Alternatively, as shown in FIG. 5H, movable blade 12 may include profile regions 158A, 154, and 158B. As described hereinabove, profile region 154 may comprise a gage region, which corresponds (upon expansion of movable blade 12) with an outermost diameter of the expandable reamer. Profile regions 158A and 158B may generally follow a parabolic or exponential (e.g., radial position as a function of longitudinal position) shape, which may be relatively durable with respect to withstanding reaming of a subterranean formation. Of course, the relative size and shape of the collective profile of a movable blade of an expandable reamer of the present invention may be selected for facilitating forming a borehole in at least one of a longitudinally upward and downward direction and through an anticipated subterranean formation, as known in the art. For example, as may be appreciated by the foregoing discussion, an expandable reamer of the present invention may be positioned (in a contracted state or condition) within a borehole, expanded and operated so as to ream a subterranean borehole in an upward or downward longitudinal direction, contracted, and removed from the reamed subterranean borehole.

In one example, for instance, an exponential shape of a movable blade profile may be determined by the following equation:

$$L=a\cdot e^{r-b}$$

wherein:

L is a longitudinal position along a blade profile;

e is the base of natural logarithms;

a is a constant;

b is a constant; and r is a radial position along the blade profile.

Such a blade shape may be advantageous for protecting cutting elements on an expandable reamer from damage during transitions between subterranean formations having different properties. Particularly, in one example, at least a portion of profile regions 158, 158A, or 158B as shown in FIG. 5G or 5H may exhibit a shape determined substantially by the above exponential equation. Explaining further, for example, at least a portion of profile region 158A may exhibit a shape determined by the above equation, but inverted (i.e., substitute "−a" for "a" in the above equation). Particularly, a longitudinally lowermost region of profile region 158 may be substantially parabolic to the longitudinal axis (e.g., longitudinal axis 11, as shown in FIG. 1A). Such a configuration may be advantageous, because the portion of the profile region 158 that is substantially parabolic to the longitudinal axis may reduce cutting element damage of the expandable reamer as the expandable reamer reams into a relatively harder subterranean formation from a relatively softer formation. Thus, such a configuration may be advantageous for inhibiting cutting element damage that may occur when a subterranean formation changes (e.g., drilling into a relatively harder subterranean formation from a relatively softer subterranean formation).

Figure 6A:
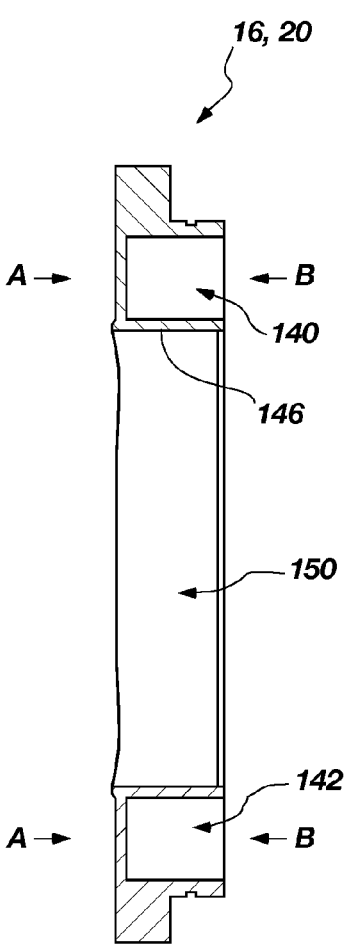
FIG. 6A is a side cross-sectional view of a retention element.
Figure 6B:
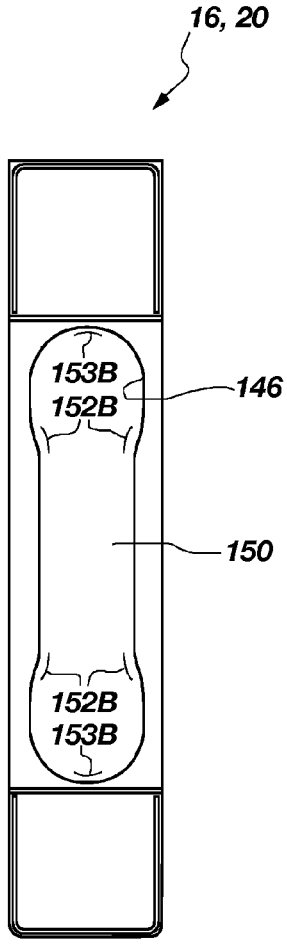
FIG. 6B is a front view of a retention element as shown in FIG. 6A.
Figure 6C:
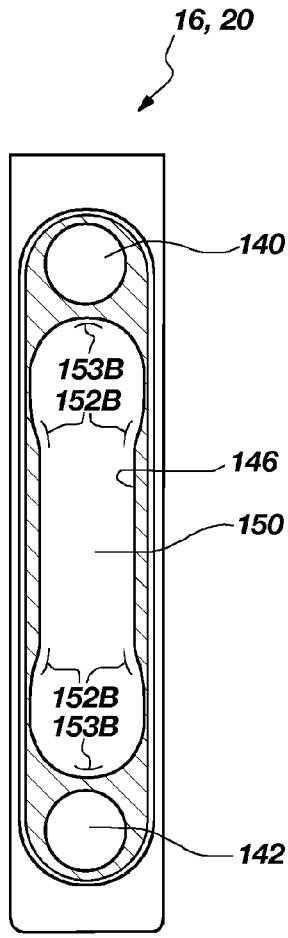
FIG. 6C is a partial cross-sectional back view of the retention element as shown in FIG. 6A.
Figure 6D:
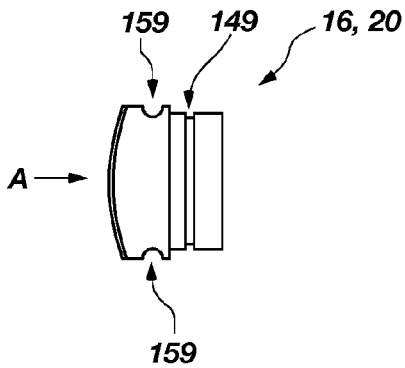
FIG. 6D is a top elevation view of the retention element as shown in FIG. 6A.

For purposes of further exploring aspects of the present invention, a retention element is described in additional detail as follows. Retention element 16, 20 is shown in FIGS. 6A-6D and may include recesses 140 and 142 and aperture 150, which forms bore surface 146 for a movable blade to move within as a piston element (i.e., piston body 122 of movable blade 12, 14 as shown in FIGS. 5A and 5C). Also, FIG. 6D shows a top elevation view of retention element 16, 20, depicting groove 149 for accepting a sealing element (62A, 62B, and 62C as shown in FIG. 4C) and recesses 159 for positioning of lock rods (e.g., lock rods 106 as shown in FIG. 4C) therein. End regions 153B and neck regions 152B of retention element 16, 20, are identified as general regions of contact between a movable blade disposed within aperture 150 due to misalignment between the piston body 122 and the aperture 150. Put another way, a piston body 122 of a movable blade 12, 14 may exhibit a substantially constant cross section with respect to its direction of movement within an aperture 150 having a substantially constant cross section with respect to the direction of movement of the movable blade 12, 14. Misalignment of the piston body 122 with respect to aperture 150 refers to a nonparallel relationship between the direction of movement of the piston body 122 of the movable blade 12, 14 and an aperture 150 within which it is positioned. Such misalignment may be caused, at least in part, by forces applied to a movable blade during drilling or reaming of a subterranean formation therewith.

Accordingly, in a further aspect of the present invention, at least one of movable blade 12, 14 and retention element 16, 20 may be configured for reducing or inhibiting misalignment of movable blade 12, 14 in relation to aperture 150 of retention element 16, 20 during movement thereof. Particularly, as may be seen in FIG. 5D, which shows a cross-sectional view taken through piston body 122, the cross-sectional shape of the piston body 122 may comprise two enlarged ends 138 connected to one another via a substantially constant body 131 portion of smaller dimension extending therebetween. Such a shape may inhibit binding of the piston body 122 as it moves laterally inwardly and outwardly during use. Particularly, tipping or rotation of movable blade 12, 14, as shown in FIG. 5A and denoted by θ (from axis X to axis Z), may cause regions 152A and 153A to contact retention element 16 (FIGS. 1A and 5D). Thus, the piston body of a movable blade may be preferentially shaped to increase the contact area with a retention element in response to tilting or rotation of the movable blade. Thus, each longitudinal side of a movable blade may comprise a generally oval, generally elliptical, tri-lobe, dog-bone, or other arcuate shape as known in the art, and configured for inhibiting misalignment of a piston body of a movable blade with respect to an aperture of a retention element within which it is positioned.

Furthermore, at least one of the piston body 122 of a movable blade 12, 14 and a bore surface 146 (FIGS. 6A-6C) of retention element 16, 20 may be structured (e.g., treated or coated) so as to reduce or inhibit wear, localized welding or galling, or other impediments (e.g., friction) to relative motion between piston body 122 and the aperture 150. For example, a nickel layer may be deposited upon at least one of the piston body 122 of a movable blade and a bore surface 146 of retention element 16, 20. Such a nickel layer may be deposited by way of electroless deposition, electroplating, chemical vapor deposition, physical vapor deposition, atomic layer deposition, electrochemical deposition, or as otherwise known in the art and may be from about 0.0001 inch to about 0.005 inch or more thick. In one embodiment, an electroless nickel layer having dispersed TEFLON® particles may be formed upon at least one of the piston body 122 of a movable blade 12, 14 and a bore surface 146 of retention element 16, 20. Such an electroless nickel layer and coating process may be commercially available from TWR Service Corporation of Schaumburg, Ill. Alternatively, other non-stick low friction materials and processes are possible. Other relatively hard coatings such as, for instance, ceramic, nitride, tungsten carbide, diamond, combinations thereof, or as otherwise known in the art may be formed upon at least one of the piston body 122 of a movable blade 12, 14 and a bore surface 146 of retention element 16, 20, without limitation.

In another aspect of the present invention, the outermost lateral position of at least one movable blade of an expandable reamer of the present invention may be configured to be selectable. Put another way, at least one movable blade may be positioned at a selectable or adjustable radially outermost position by way of at least one spacer element. Thus, an expandable reamer of the present invention may be adjustable in its reaming diameter. Such a configuration may be advantageous to reduce inventory and machining costs, and for flexibility in use of an expandable reamer.

Figure 7A:
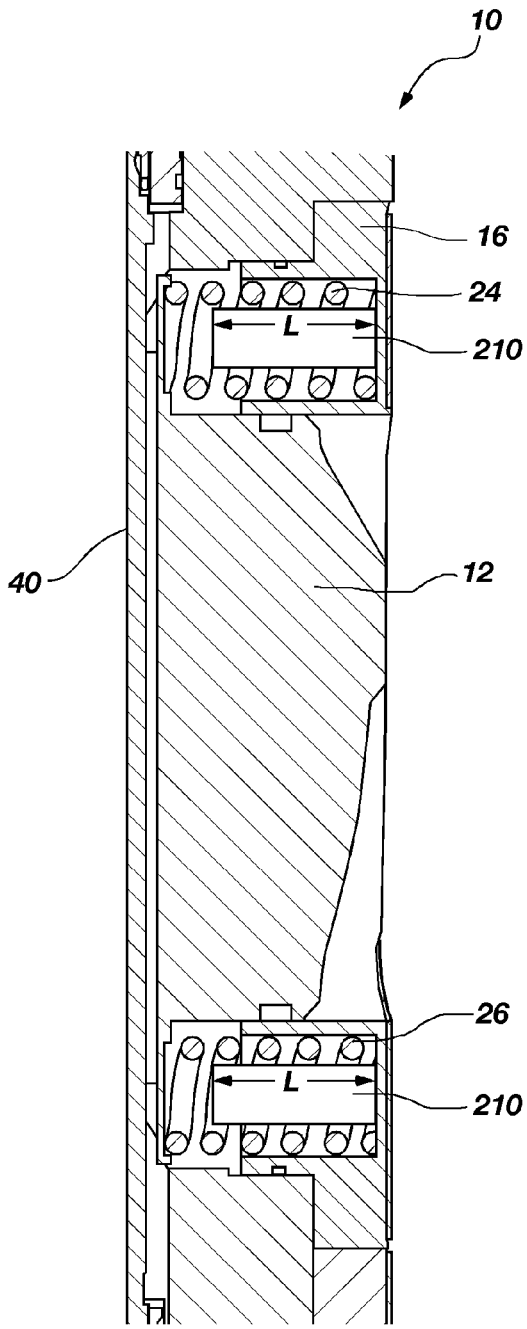
FIG. 7A is an enlarged, partial cross-sectional view of a movable blade of an expandable reamer of the present invention including two blade spacer elements.

In one embodiment, FIG. 7A shows spacer elements 210 positioned between retention element 16 and movable blade 12. More specifically, for example, length "L" as shown in FIG. 7A may be selected so that the outermost radial or lateral position of movable blade 12 may be adjusted accordingly when movable blade 12 abuts thereagainst. Spacer elements 210 may be disposed within blade-biasing elements 24 and 26, respectively, as shown in FIG. 7A, may be affixed to movable blade 12 or retention element 16 or, alternatively, may freely move therein. Thus, utilizing adjustable spacer elements 210 may allow for a particular movable blade to be employed in various borehole sizes and applications. For instance, the expandable reamer of the present invention including adjustable spacer elements may enlarge a particular section of borehole to a first diameter, then may be removed from the borehole and another set of adjustable spacer elements having a different length "L" may replace adjustable spacer elements, then the expandable reamer may be used to enlarge another section of borehole at a second diameter. Further, minor adjustment of the outermost lateral position of the movable blade 12 may be desirable during drilling operations by way of threads or other adjustment mechanisms when adjustable spacer elements 210 may be affixed to either of the movable blade 12 or retention element 16.

Figure 7B:
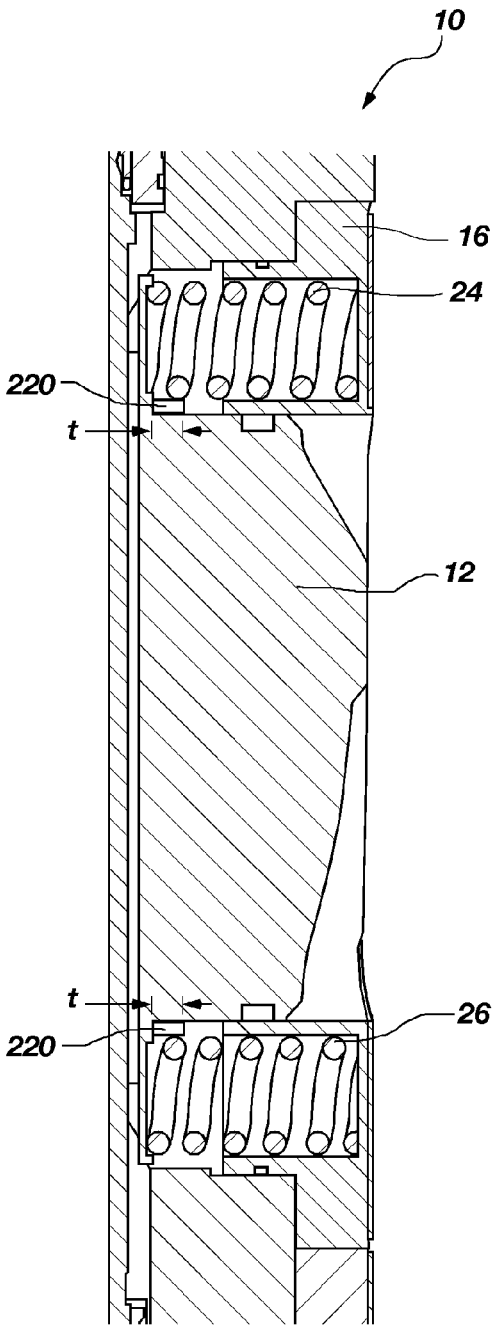
FIG. 7B is an enlarged, partial cross-sectional view of a movable blade of an expandable reamer of the present invention including an alternative blade spacer element embodiment.
Figure 7C:
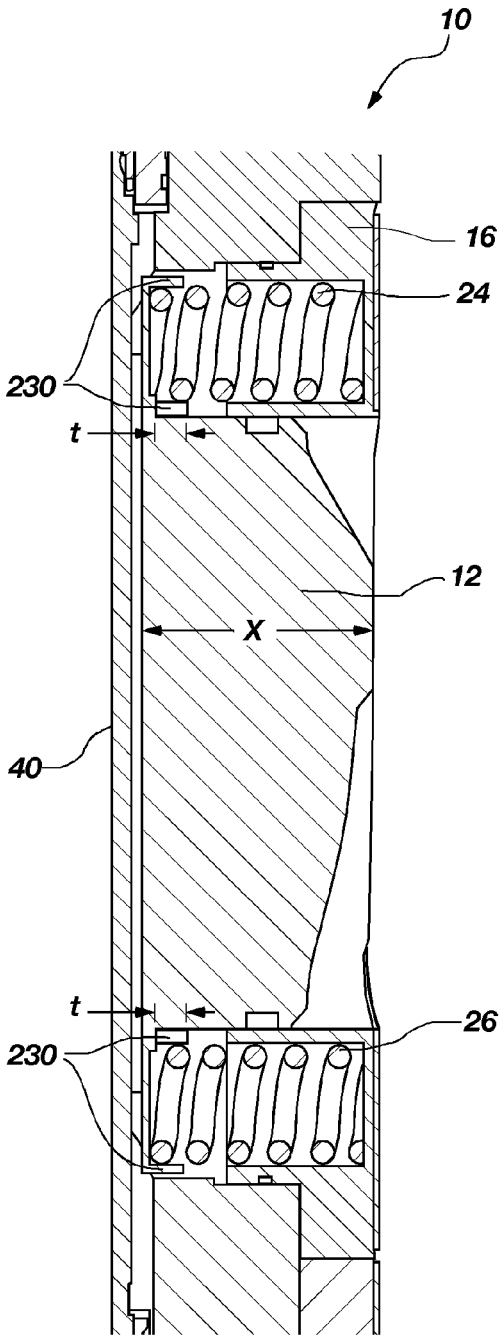
FIG. 7C is an enlarged, partial cross-sectional view of a movable blade of an expandable reamer of the present invention including a further alternative blade spacer element embodiment.
Figure 7D:
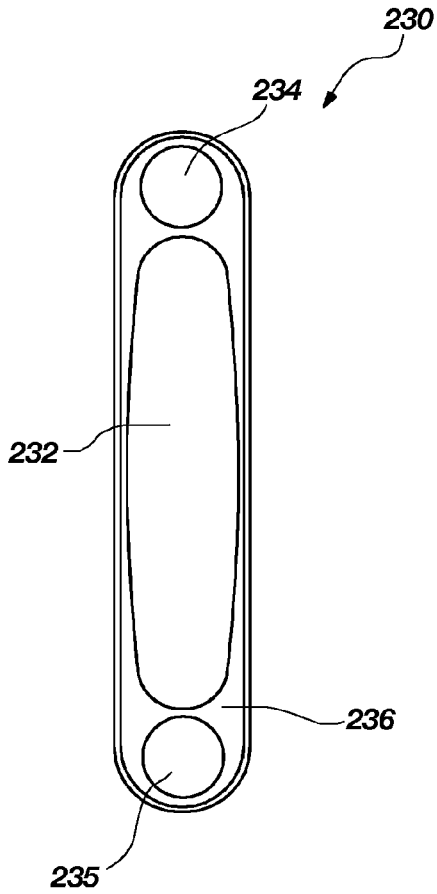
FIG. 7D is a front view of the blade spacer element shown in FIG. 7C.

In another embodiment, FIG. 7B shows spacing element 220, which is configured as a continuous band fitting about the periphery of movable blade 12 (i.e., about piston body 122 as shown in FIG. 5A, for instance). Accordingly, thickness "t" of spacing element 220 may be selected so that the outermost radial or lateral position of movable blade 12 may be adjusted accordingly when spacing element 220 abuts against both movable blade 12 and retention element 16. Such a configuration may be advantageous for ease of installation and manufacturing. In yet a further embodiment, FIGS. 7C and 7D show that spacing element 230 may exhibit a contact area 236 that substantially mimics an area of the retention element 16 facing toward the movable blade 12. Explaining further, as shown in FIG. 7D, retention element 16 may provide a contact area 236 extending proximate the periphery of aperture 232, as well as near the region of both the upper and lower ends thereof. Accordingly, it may be appreciated that the contact area 236, defined by a generally oval shape from which apertures 232, 234, and 235 have been removed, of spacing element 230, as shown in FIG. 7D, substantially mimics the contact surface of movable blade 12 facing toward spacing element 230. Of course, a cross-sectional contact area of spacing element 230 may be tailored to match the cross-sectional size and shape of the piston body of a movable blade with which it may be assembled.

Alternatively, if a spacing element is undesirable, as shown in FIG. 7C, a lateral thickness X of movable blade 12 may be selected and movable blade 12 may be configured for exhibiting a selected outermost radial or lateral position. Further, the present invention contemplates that a movable blade within an expandable reamer of the present invention may be replaced by a differently configured movable blade, as may be desired.

Figure 8A:
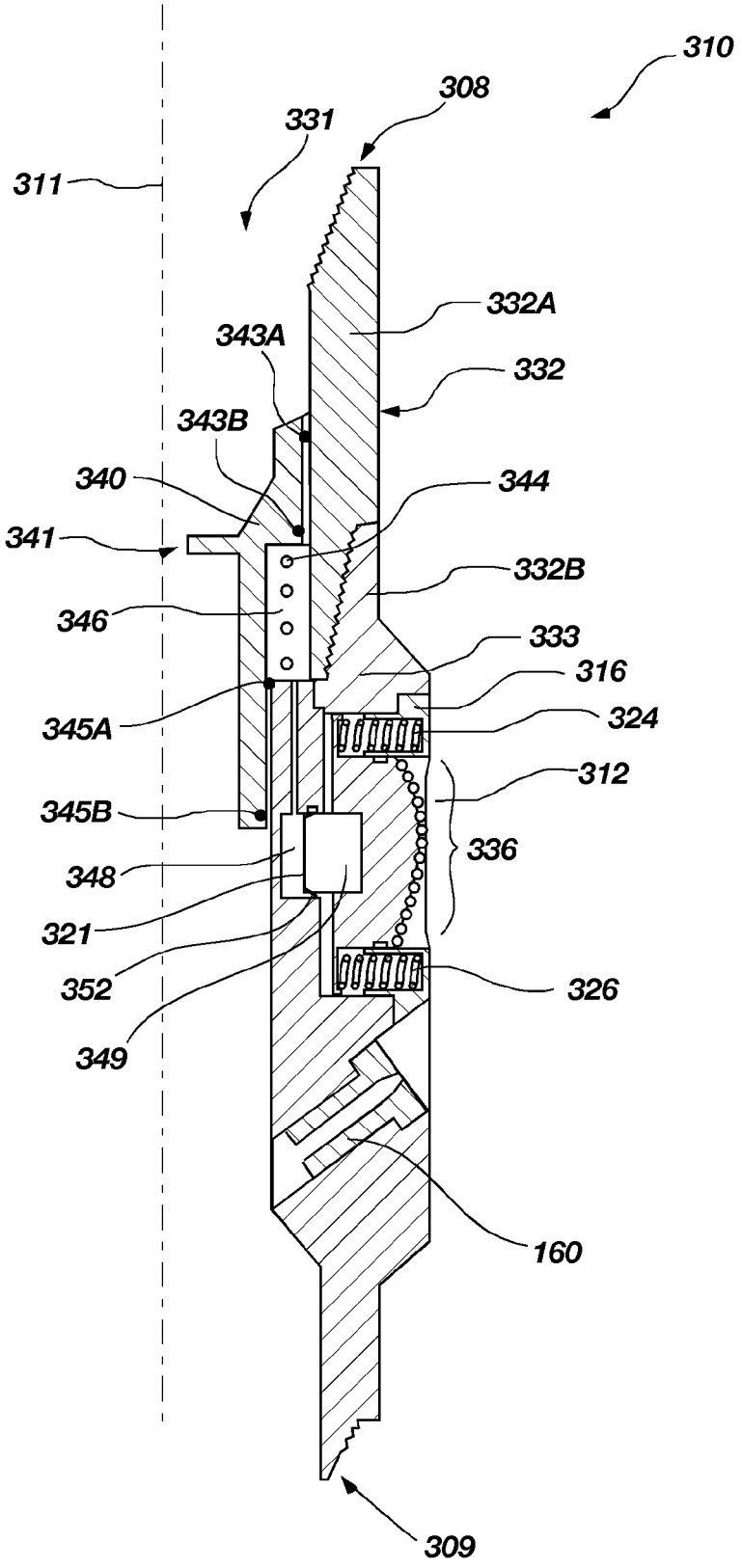
FIG. 8A is a conceptual side cross-sectional view of an embodiment of an expandable reamer of the present invention in an expanded state.

Of course, many alternatives are contemplated by the present invention in relation to a movable blade extending through the expandable reamer. For instance, a movable blade of an expandable reamer of the present invention may be moved laterally outwardly by way of at least one intermediate piston element. In one embodiment as shown in FIG. 8A, a pressurization sleeve may be configured for actuating at least one movable blade of an expandable reamer while maintaining the cleanliness and functionality of the at least one movable blade thereof. For example, FIG. 8A shows a partial side cross-sectional view of an expandable reamer 310 of the present invention including movable blade 312 outwardly spaced from the centerline or longitudinal axis 311 of the tubular body 332 (comprising upper tubular body section 332A and lower tubular body section 332B), affixed therein by way of retention elements 316 and carrying cutting elements 336. Also, a nozzle 160 is shown in FIG. 8A positioned below movable blade 312 and oriented at an angle with respect to longitudinal axis 311 so as to direct drilling fluid that flows therethrough toward cutting elements 336 carried by movable blade 312, when movable blade 312 is positioned at a laterally outermost position.

Tubular body 332 includes a bore 331 therethrough for conducting drilling fluid as well as a male-threaded pin connection 309 and a female-threaded box connection 308. As shown in FIG. 8A, expandable reamer 310 may include a pressurization sleeve 340 having a reduced cross-sectional orifice 341 and may also include sealing elements 343A, 343B, 345A, and 345B positioned between the pressurization sleeve 340 and the tubular body 332. Reduced cross-sectional orifice 341 may be sized for producing a selected magnitude of force as in relation to a magnitude of a flow rate of drilling fluid passing therethrough. Also, an annular chamber 346 may be formed between pressurization sleeve 340 and tubular body 332, while another chamber 348 may be formed within tubular body 332, in communication with piston element 349. Piston element 349 may be effectively sealed within upper tubular body section 332A by way of sealing element 352. Such a configuration may substantially inhibit drilling fluid from contacting the inner surface 321 of movable blade 312.

Thus, during operation, drilling fluid may force (via fluid drag, pressure, momentum, or a combination thereof) the pressurization sleeve 340 longitudinally downwardly, while a fluid (e.g., oil, water, etc.) within chamber 348 may become pressurized in response thereto. Further, biasing element 344 may resist the downward longitudinal displacement of pressurization sleeve 340 while in contact therewith. Of course, biasing element 344 may cause the pressurization sleeve 340 to return longitudinally upwardly if the magnitude of the downward force caused by the drilling fluid passing through the reduced cross-sectional orifice 341 of the pressurization sleeve 340 is less than the upward force of the biasing element 344 thereon. Additionally, a valve apparatus 333 may be configured for selective control of communication between the annular chamber 346 and chamber 348. For example, valve apparatus 333 may be configured for preventing hydraulic communication between annular chamber 346 and chamber 348 until a minimum selected pressure magnitude is experienced within annular chamber 346. Alternatively, valve apparatus 333 may be configured for allowing hydraulic communication between annular chamber 346 and chamber 348 in response to a user input or other selected condition (e.g., a minimum magnitude of pressure developed within annular chamber 346). Accordingly, movable blade 312 may remain positioned laterally inwardly until valve apparatus 333 allows hydraulic communication between annular chamber 346 and chamber 348.

Explaining further, once communication between annular chamber 346 and chamber 348 is allowed, pressure acting on piston element 349 may cause movable blade 312 to move laterally outwardly, against blade-biasing elements 324 and 326. Thus, piston element 349 may be forced against movable blade 312 in response to sufficient pressure communicated to chamber 348. Once movable blade 312 is positioned at a suitable lateral position, reaming of a subterranean formation may be performed. Optionally, a shear pin (not shown) or other friable element (not shown) may restrain at least one of pressurization sleeve 340 in its initial longitudinal position and movable blade 312 in its initial lateral position, as shown in FIG. 8A.

Figure 8B:
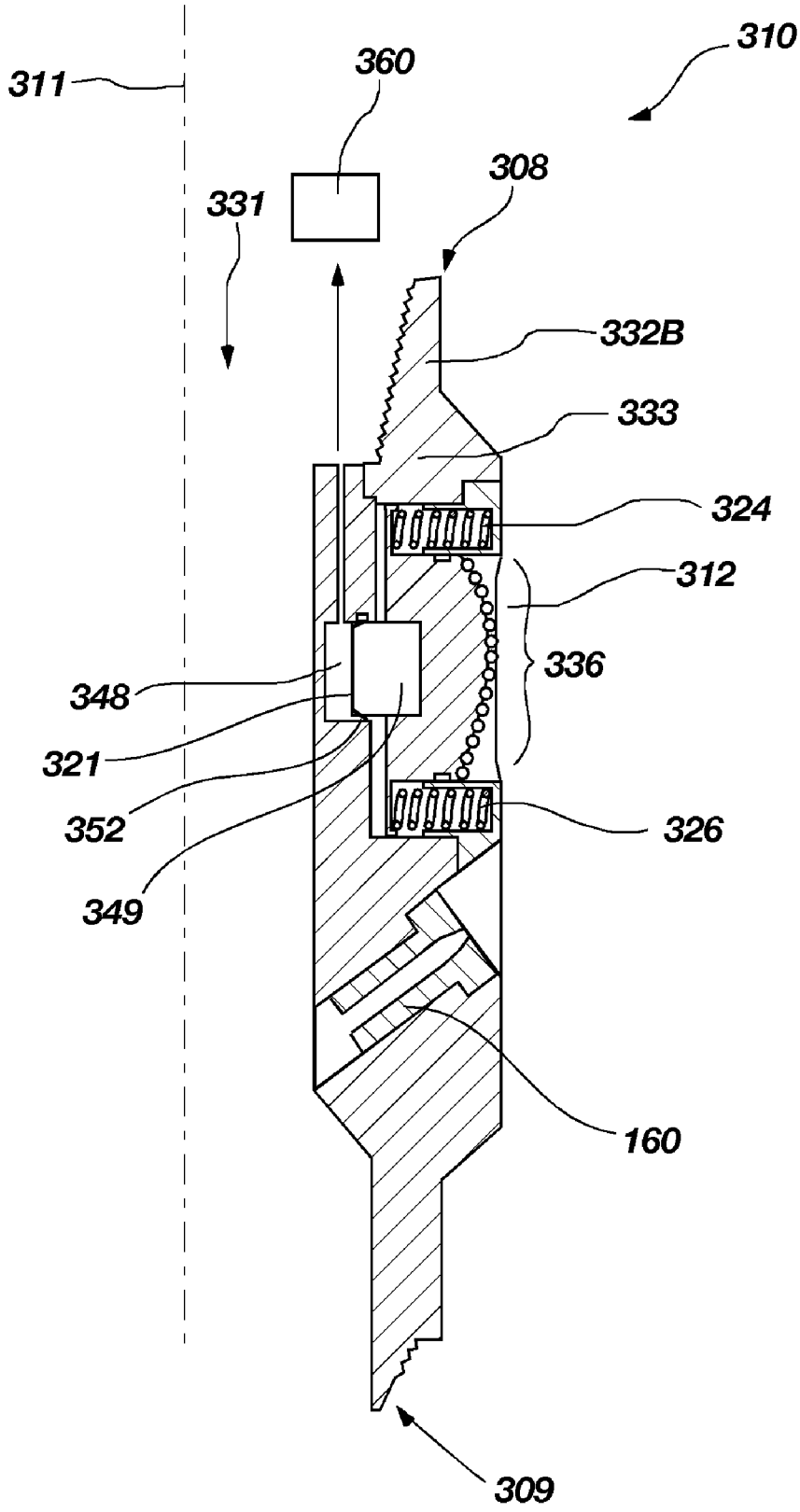
FIG. 8B is a conceptual partial side cross-sectional view of another embodiment of expandable reamer of the present invention in an expanded state.

Alternatively, instead of a pressurization sleeve that transmits or communicates a fluid in communication with a movable blade, a movable blade may be displaced by a pressure source that pressurizes a fluid or gas in communication with the movable blade. For instance, in reference to FIG. 8B, an expandable reamer 310 is shown that is generally as described above in relation to FIG. 8A but without upper tubular body section 332A. Explaining further, pressurized fluid or gas may be communicated to chamber 348 by way of a pressure source 360. Pressure source 360 may comprise a downhole pump or turbine operably coupled to valve apparatus 333 and for communicating a pressurized fluid therethrough. Also, valve apparatus 333 may be selectively and reversibly operated. For instance, valve apparatus may comprise a solenoid actuated valve as known in the art. Accordingly, movable blade 312 may be deployed by way of pressurized fluid from pressure source 360. Such a configuration may allow for expandable reamer 310 to be expanded substantially irrespective of drilling fluid flow rates or pressures. Of course, many configurations may exist where the movable blades may communicate with a nondrilling fluid pressurized by a downhole pump or turbine. For instance, an expandable reamer may be configured as shown in any embodiments including an actuation sleeve as shown hereinabove, wherein the actuation sleeve is fixed in a position for separating drilling fluid from communication with any movable blades and a port may be provided to pressurize the movable blades.

Figure 8C:
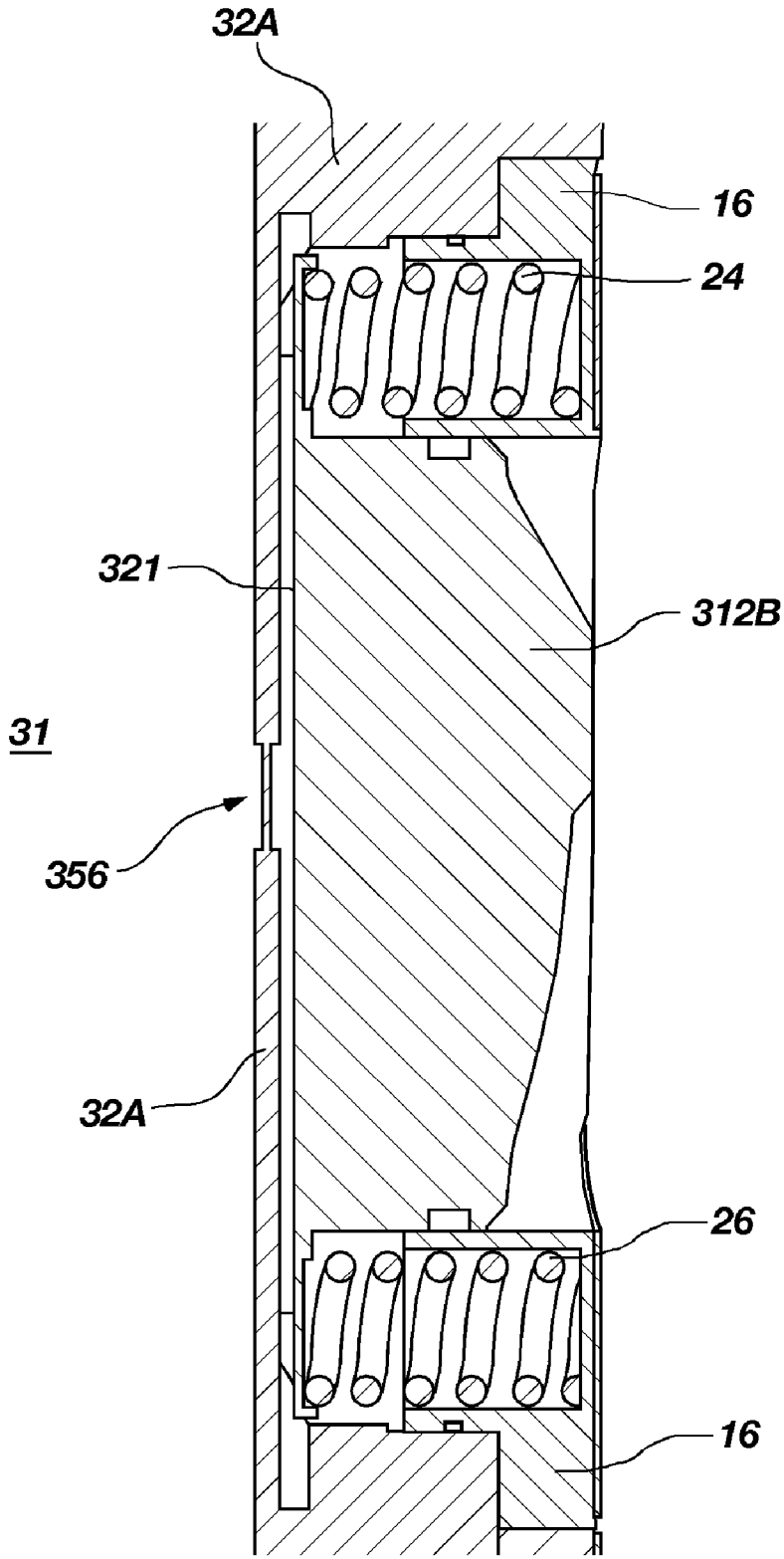
FIG. 8C is an enlarged, partial side cross-sectional view of a movable blade of an expandable reamer of the present invention including a frangible element for preventing or allowing pressurized fluid communication therewith.

In another aspect of the present invention, at least one frangible element may be employed for selectively allowing or preventing drilling fluid communication with a movable blade of an expandable reamer. In one example, FIG. 8C shows an enlarged side cross-sectional view of a movable blade 312B of an expandable reamer of the present invention (e.g., an expandable reamer as shown in FIGS. 1A-1E), positioned within a recess formed in upper tubular body section 32A. Further, the at least one frangible element 356 (e.g., at least one burst disc) may be positioned within upper tubular body section 32A. Thus, at least one frangible element 356 may be structured for failing in response to at least a selected pressure within bore 31 of the expandable reamer being experienced. Accordingly, when the at least one frangible element 356 fails, bore 31 and inner surface 321 may hydraulically communicate, which may, as described hereinabove, cause movable blade 312B to move laterally outward, against the forces of blade-biasing elements 24 and 26.

Figure 8D:
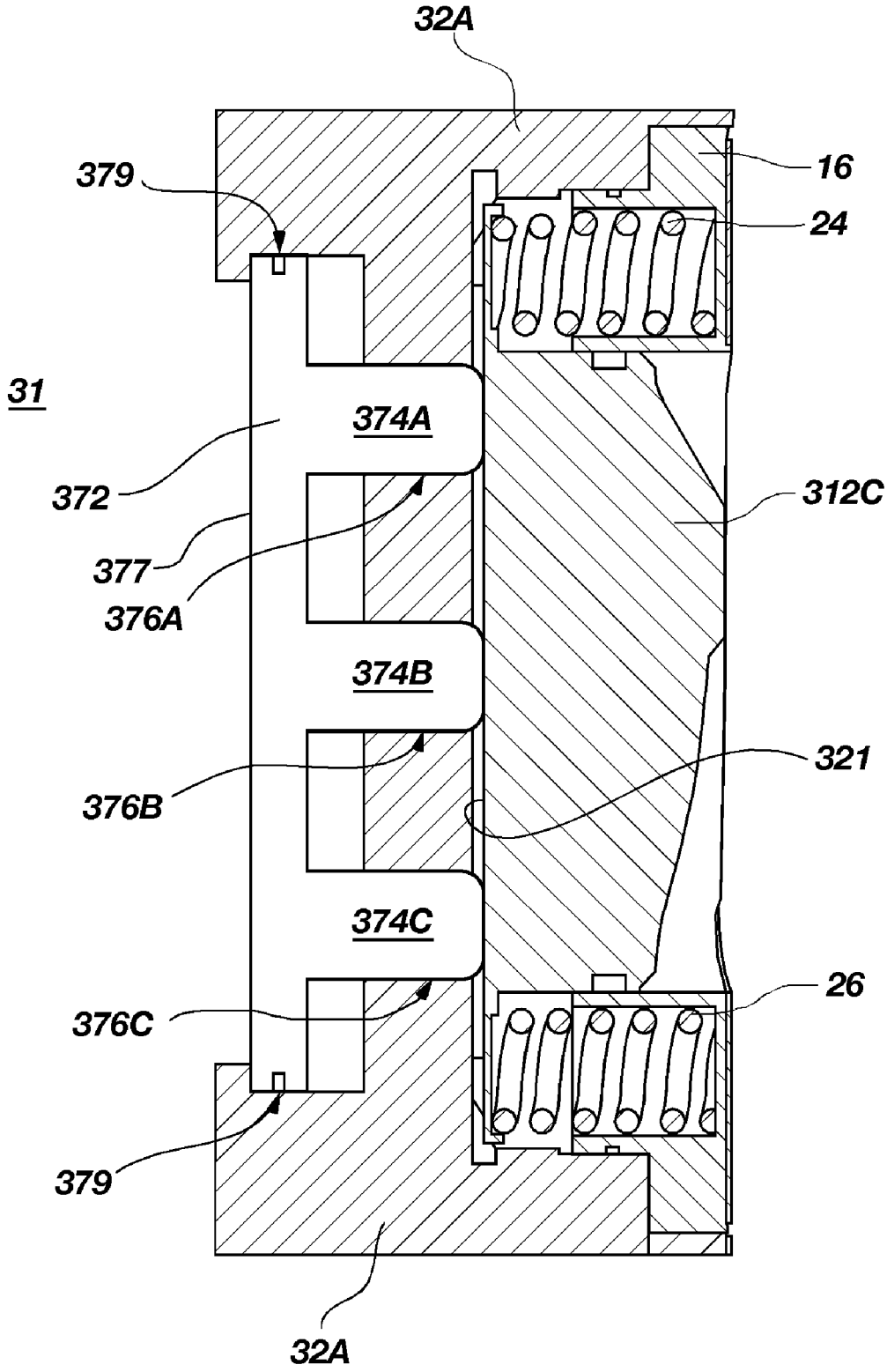
FIG. 8D is an enlarged, partial side cross-sectional view of a movable blade of an expandable reamer of the present invention including an intermediate piston element having a plurality of protrusions for moving the movable blade.

In a further embodiment contemplated by the present invention, drilling fluid may act upon at least one intermediate piston element for moving a movable blade of an expandable reamer of the present invention. In one exemplary embodiment, as shown in FIG. 8D, intermediate piston element 372 may be configured for displacing movable blade 312C. In further detail, intermediate piston element 372 may be positioned within a cavity formed in upper tubular body section 32A and sealed thereagainst by sealing element 379. Further, protrusions 374A, 374B, and 374C may extend from piston element 372 through apertures 376A, 376B, and 376C, respectively, that are formed in upper tubular body section 32A and toward inner surface 321 of movable blade 312C. Explaining further, pressure acting on inner surface 377 of intermediate piston element 372, causing protrusions 374A, 374B, and 374C to contact the inner surface 321 of movable blade 312C, which may cause movable blade 312C to move laterally outwardly against blade-biasing elements 24 and 26. Of course, movable blade 312C may be structured in relation to contact areas of protrusions 374A, 374B, and 374C with inner surface 321. Once movable blade 312C is positioned at a suitable lateral position, reaming of a subterranean formation may be performed. Such a configuration may be advantageous for inhibiting contact between drilling fluid and movable blade 312C.

Figure 8E:
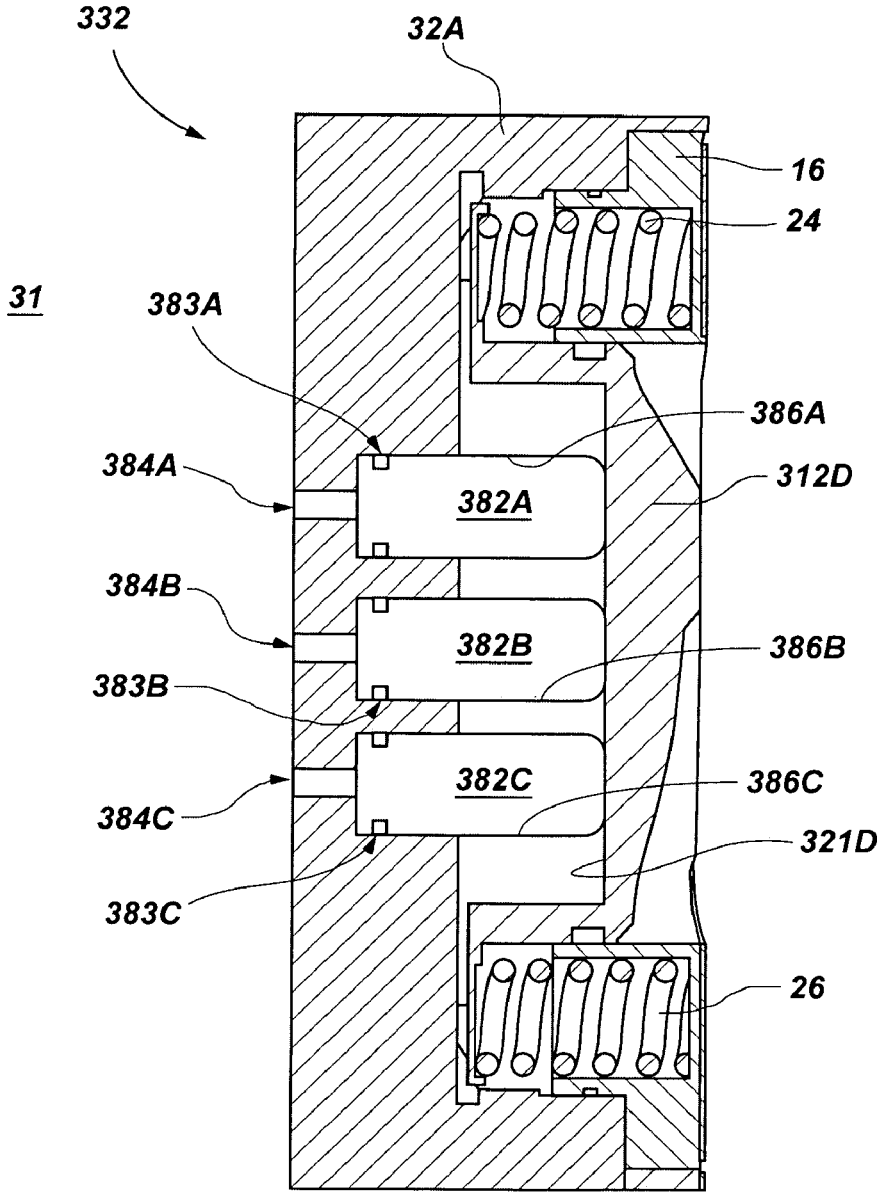
FIG. 8E is an enlarged, partial side cross-sectional view of a movable blade of an expandable reamer of the present invention including a plurality of intermediate piston elements for moving the moveable blade.

In a further aspect contemplated by the present invention, drilling fluid may act upon a plurality of intermediate piston elements for moving a movable blade of an expandable reamer of the present invention. In an exemplary embodiment, as shown in FIG. 8E, intermediate piston elements 382A, 382B, and 382C may be configured for displacing movable blade 312D. Also, movable blade 312D may be recessed for accommodating at least a portion of each of intermediate piston elements 382A, 382B, and 382C. Each of sealing elements 383A, 383B, and 383C may be associated with each of intermediate piston elements 382A, 382B, and 382C, respectively, and may be configured for sealing engagement between each of intermediate piston elements 382A, 382B, and 382C and tubular body 332. Such a configuration may provide a relatively compact design for displacing movable blade 312D.

Thus, during operation, intermediate piston elements 382A, 382B, and 382C may extend through respective apertures 386A, 386B, and 386C formed in upper tubular body section 32A and toward inner surface 321D of movable blade 312D. Explaining further, pressure acting on each of intermediate piston elements 382A, 382B, and 382C through ports 384A, 384B, and 384C may cause intermediate piston elements 382A, 382B, and 382C to contact the inner surface 321D of movable blade 312D, which may cause movable blade 312D to move laterally outwardly, against blade-biasing elements 24 and 26. Of course, movable blade 312D may be structured in relation to contact areas of intermediate piston elements 382A, 382B, and 382C against inner surface 321D. Once movable blade 312D is positioned at a suitable lateral position, reaming of a subterranean formation may be performed.

Figure 9A:
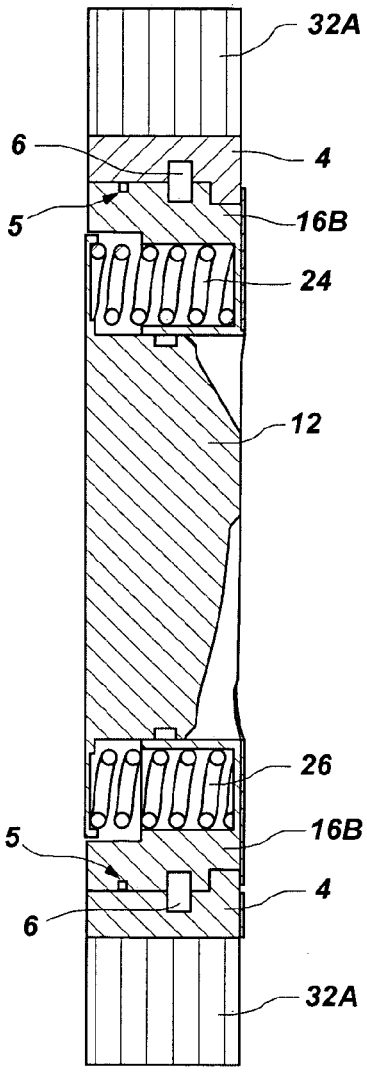
FIG. 9A is an enlarged, partial side cross-sectional view of a movable blade of an expandable reamer of the present invention affixed within an intermediate element affixed to a tubular body of the expandable reamer by way of a frangible element.

The present invention further contemplates that a movable blade may be structured for returning laterally inwardly even if blade-biasing elements 24 and 26 fail to cause a movable blade do so. Particularly, FIG. 9A shows movable blade 12 positioned within an intermediate element 4 and affixed thereto by way of at least one frangible element, for instance, shown as two shear pins 6. Further, intermediate element 4 may be affixed to upper tubular body section 32A by way of lock rods (e.g., lock rods 106 as shown in FIG. 4C). Thus, movable blade 12 may operate generally as described above, however, if movable blade 12 becomes stuck in an outward lateral position, a laterally inward force applied to movable blade 12 may cause the at least one frangible element, in this embodiment shown as two shear pins 6, to fail, which, in turn, may allow movable blade 12 as well as retention element 16B to move laterally inwardly. For example, shear pins 6 may be caused to fail by moving the expandable reamer (e.g., expandable reamer 10, as shown in FIGS. 1A-1E) longitudinally (i.e., under a longitudinal force) into a bore that is smaller than the nominal size of the expandable reamer 10 in an at least partially expanded condition. Contact between the movable blade 12 and a bore (e.g., a casing or borehole) of a smaller size may generate significant inward lateral force sufficient to fail shear pins 6. Such a configuration may provide an alternative manner for causing movable blade 12 to move laterally inwardly other than by blade-biasing elements 24 and 26. Of course, shear pins 6 may be structured to resist anticipated forces that may be experienced during reaming operations without failing.

Figure 9B:
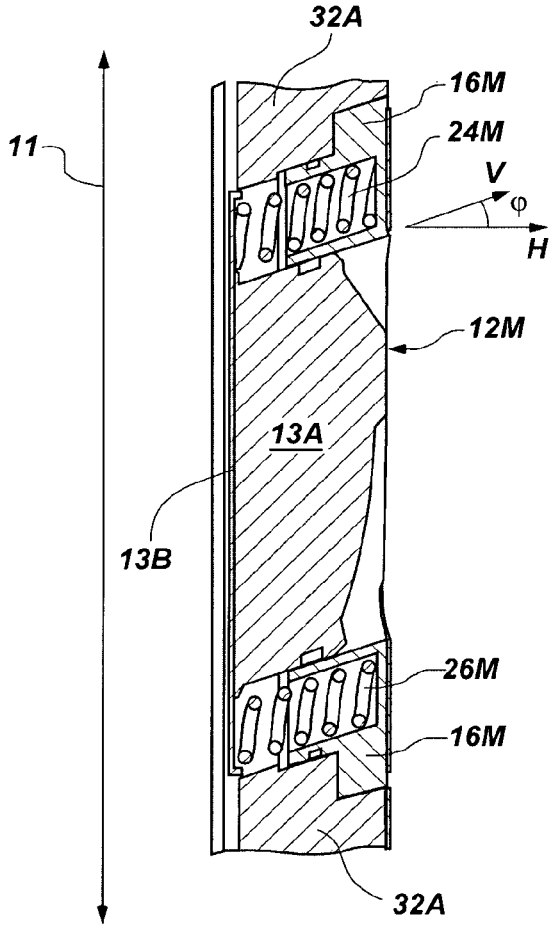
FIG. 9B is an enlarged, partial side cross-sectional view of a movable blade of an expandable reamer of the present invention wherein the movable blade is structured for movement along a direction that is non-perpendicular to the longitudinal axis of the expandable reamer.

In another aspect of the present invention, FIG. 9B shows a movable blade 12M configured to in move in a direction substantially parallel to axis V (i.e., non-perpendicular to longitudinal axis 11, which is oriented at an angle $\phi$ with respect to horizontal axis H. Such a configuration may be advantageous for forcing movable blade 12M from an expanded position laterally inwardly if blade-biasing elements 24M and 26M fail to do so. As mentioned hereinabove, "lateral" or "radial," as used herein, encompasses a direction of movement of a movable blade that is at least partially longitudinal, as is shown in FIG. 9B. Explaining further, a longitudinal downward force which is applied to movable blade 12M may cause movable blade 12M to move laterally inwardly because a portion of the longitudinal downward force may be resolved in a laterally inward direction along the mating surfaces between movable blade 12M and retention element 16M. Thus, by moving an expandable reamer (e.g., expandable reamer 10 as shown in FIGS. 1A-1E) longitudinally upwardly within a subterranean borehole or other bore that is smaller than an expanded diameter of the expandable reamer (e.g., a casing or other tubular element positioned within a subterranean borehole), a movable blade 12M may impact or become wedged therein. Continuing to pull upward upon the expandable reamer 10 may cause a substantial downward longitudinal force to be applied to movable blade 12M, which may also develop a substantial inward lateral force, thus displacing movable blade 12M laterally inward and allowing the expandable reamer 10 to continue longitudinally upward within the bore (not shown).

Also, it may be appreciated that fabrication of movable blade 12M may be facilitated by forming a blade plate 13B that is affixed to an angled movable blade body 13A. For instance, it may be advantageous to weld or mechanically affix (e.g., via bolts or other threaded fasteners) blade plate 13B to angled movable blade body 13A. Such a configuration may simplify fabrication of movable blade 12M.

The present invention further contemplates that at least a portion of a surface of an expandable reamer may be covered or coated with a material for resisting abrasion, erosion, or both abrasion and erosion. Generally, a substantial portion of the exterior of an expandable reamer may be configured for resisting wear (e.g., abrasion, erosion, contact wear, or combinations thereof). In one embodiment, hardfacing material may be applied to at least one surface of an expandable reamer, wherein at least two different hardfacing material compositions are utilized and specifically located in order to exploit the material characteristics of each type of hardfacing material composition employed. The use of multiple hardfacing material compositions may further be employed as a wear-resistant coating on various elements of the expandable reamer. The surfaces to which hardfacing material is applied may include machined slots, cavities or grooves providing increased surface area for application of the hardfacing material. Additionally, such surface features may serve to achieve a desired residual stress state in the resultant hardfacing material layer or other structure.

For example, one surface that may be configured for resisting wear may include an exterior surface S of bearing pads 34 and 38, as shown in FIG. 1A. With respect to surface S, bearing pads 34 and 38 may comprise hardfacing material, diamond, tungsten carbide, tungsten carbide bricks, tungsten carbide matrix, or superabrasive materials. The present invention further contemplates that surface S may comprise at least one hardfacing material. A hardfacing material, as known in the art and as used herein, refers to a material formulated for resisting wear. Hardfacing materials may include materials deposited by way of flame-spraying, welding, via laser beam heating, or as otherwise known in the art. Optionally, hardfacing material may be applied according to a so-called "graded-composite" process, as known in the art. More specifically, different types of hardfacing material may be applied upon a portion of a surface of an expandable reamer adjacent to one another, or at least partially superimposed with respect to one another, or both.

Exemplary materials and processes for forming hardfacing material are disclosed in U.S. Pat. No. 6,651,756 to Costo, Jr. et al., assigned to the assignee of the present invention, the disclosure of which is incorporated, in its entirety, by reference herein. In one configuration, hardfacing material may generally include some form of hard particles delivered to a surface via a welding delivery system (e.g., by hand, robotically, or as otherwise known in the art). Hard particles may come from the following group of cast or sintered carbides (e.g., monocrystalline) including at least one of chromium, molybdenum, niobium, tantalum, titanium, tungsten, and vanadium and alloys and mixtures thereof. RE 37,127 of U.S. Pat. No. 5,663,512 to Schader et al., assigned to the assignee of the present invention, the disclosure of which is incorporated herein in its entirety by this reference, discloses, by way of example and not by limitation, some exemplary hardfacing materials and some exemplary processes that may be utilized by the present invention. Other hardfacing materials or processes, as known in the art, may be employed for forming hardfacing material upon an expandable reamer of the present invention.

For example, sintered, macrocrystalline, or cast tungsten carbide particles may be captured within a mild steel tube, which is then used as a welding rod for depositing hardfacing material onto the desired surface, usually, but optionally, in the presence of a deoxidizer, or flux material, as known in the art. The shape, size, and relative percentage of different hard particles may affect the wear and toughness properties of the deposited hardfacing, as described by RE 37,127 to Schader et al. For example, a relatively hard (e.g., having a relatively high percentage of tungsten carbide) may be applied on at least a portion of a gage surface of the expandable reamer, while at least a portion of a non-gage surface of the expandable reamer may be coated with a so-called macrocrystalline tungsten carbide hardfacing material.

Additionally, U.S. Pat. No. 5,492,186 to Overstreet et al., assigned to the assignee of the present invention, the disclosure of which is incorporated herein in its entirety by this reference, describes a bi-metallic gage hardfacing configuration for heel row teeth on a roller cone drill bit. Thus, the characteristics of a hardfacing material may be customized to suit a desired function or environment associated with a particular surface of an expandable reamer of the present invention.

Additionally or alternatively, other known materials for resisting wear of a surface, including surface hardening (e.g., nitriding), ceramic coatings, or other plating processes or materials may be employed upon at least a portion of a surface of an expandable reamer according to the present invention.

Figure 10A:
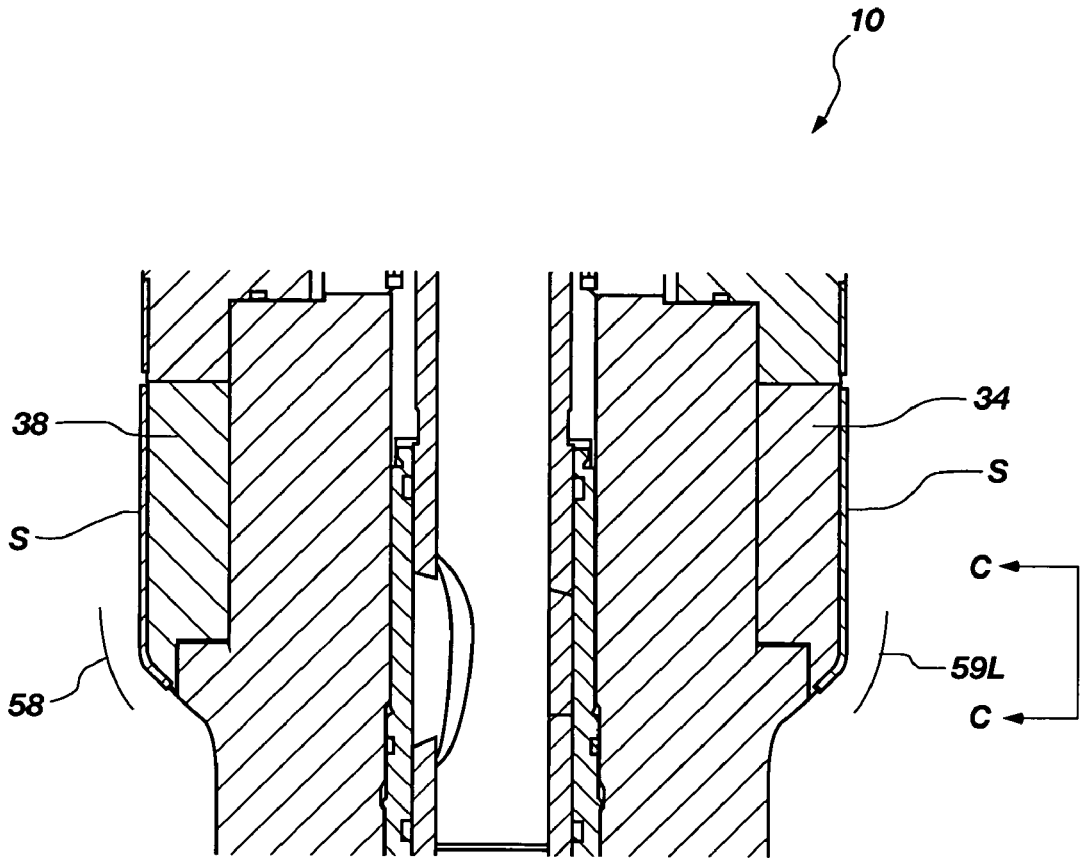
FIG. 10A is an enlarged, partial side cross-sectional view of a portion of an expandable reamer as shown in FIGS. 1A-1E including bearing pads.

In a further aspect of bearing pads 34 and 38, a hardfacing pattern may be formed thereon. More particularly, FIG. 10A shows an enlarged view of a portion of expandable reamer 10 including bearing pads 34 and 38. According to the present invention, at least lower longitudinal regions 58 and 59L of at least one of bearing pads 34 and 38 may include a hardfacing pattern formed thereon. Explaining further, during use, an expandable reamer may include a pilot bit installed on a leading longitudinal end thereof. Further, such a pilot drill bit may be used for drilling, for instance, through a cementing shoe or into a subterranean formation. Even though a pilot bit may be sized for drilling a subterranean borehole large enough for the expandable reamer to pass through when the at least one movable blade thereof is not expanded, abrasive wear may occur on the bearing surfaces of the expandable reamer 10, for instance, surfaces S of the bearing pads 34 and 38. In addition, wear may occur on the movable blades (not shown), despite being positioned at its laterally innermost position, due to excessive contact with the borehole formed by a pilot drill bit.

Figure 10B:
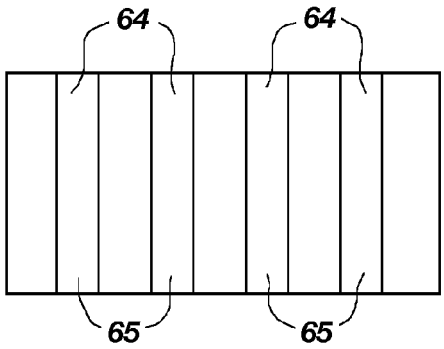
FIGS. 10B-10E are views of alternative embodiments of a portion of a surface of a bearing pad as shown in FIG. 10A, taken in accordance with reference line C-C as shown in FIG. 10*a*.
Figure 10C:
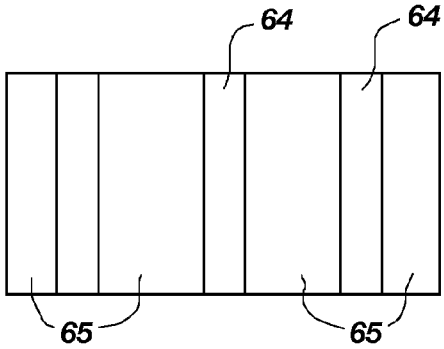
Figure 10D:
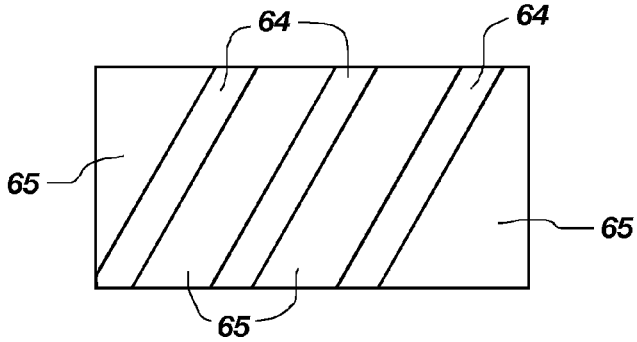
Figure 10E:
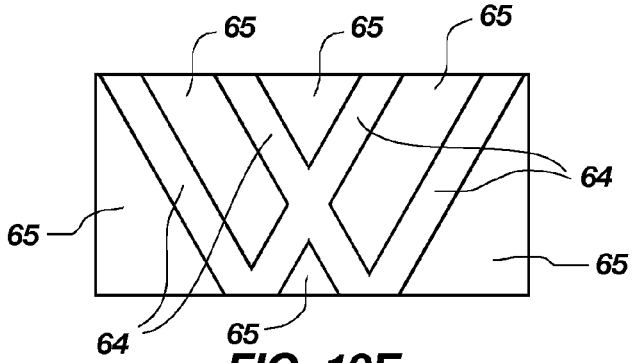

Therefore, the present invention contemplates that hardfacing patterns such as those shown in FIGS. 10B-10B may be utilized upon the lower longitudinal regions 58 and 59L of at least one of bearing pads 34 and 38. In further detail, FIGS. 10B-10B each show a view of bearing pad 34 in a direction as shown in FIG. 10A by reference lines C-C. As shown in each of FIGS. 10B-10E, a plurality of protruding ridges 64 of wear-resistant material (e.g., hardfacing, diamond, or other wear-resistant material as known in the art) may be positioned in alternating or overlapping relationships, or otherwise oriented as desired, without limitation, upon a surface of bearing pad 34. Put another way, the plurality of protruding ridges 64 may be separated by gaps or recesses 65. Such a configuration may provide a surface having substantial wear resistance, but also may exhibit a reaming or drilling capability during rotation of an expandable reamer. Thus, during operation, the plurality of protruding ridges 64 may precede the portion of expandable reamer longitudinally thereabove and may remove portions of the borehole that may otherwise excessively contact and wear the expandable reamer, thus providing a degree of protection thereto.

Further, optionally, at least a portion of an expandable reamer of the present invention may be coated with an adhesion-resistant coating, such as a relatively low adhesion, preferably nonwater-wettable surface as disclosed by U.S. Pat. No. 6,450,271 to Tibbitts et al., which is assigned to the assignee of the present invention and the disclosure of which is incorporated in its entirety by reference herein. More particularly, at least a portion of a surface of an expandable reamer may include a material providing reduced adhesion characteristics for subterranean formation material in relation to a surface that does not include the material. Particularly, it may be desirable for an adhesion-resistant coating to exhibit a relatively high shale release property. Further, such an adhesion-resistant coating may exhibit a surface finish roughness of about 32μ inches or less, RMS. Also, such an adhesion-resistant coating may exhibit a sliding coefficient of friction of about 0.2 or less. One exemplary material for an adhesion-resistant coating may include a vapor-deposited, carbon-based coating exhibiting a hardness of at least about 3000 Vickers. In a further aspect, an adhesion-resistant coating may exhibit a surface having lower surface-free energy and reduced wettability by at least one fluid in comparison to an untreated portion of a surface of an expandable reamer. Such a configuration may inhibit adhesion of formation cuttings carried by the drilling fluid with a surface having the adhesion-resistant coating. Exemplary materials for an adhesion-resistant coating may include at least one of: a polymer, a PTFE, a FEP, a PFA, a ceramic, a metallic material, and a plastic, a diamond film, monocrystalline diamond, polycrystalline diamond, diamond-like carbon, nanocrystalline carbon, vapor-deposited carbon, cubic boron nitride, and silicon nitride.

In yet a further aspect of the present invention, cutting elements and depth-of-cut-limiting features positioned upon a movable blade of an expandable reamer may be configured as disclosed in U.S. Pat. Nos. 6,460,631 and 6,779,613, both to Dykstra et al. Such a configuration may be advantageous for directionally reaming a borehole in a subterranean formation. Conventional depth-of-cut configurations for drill bits may be, at least in part, known and included by so-called "EZSteer" technology, which is commercially available for drill bits from Hughes Christensen Company of Houston, Tex.

Figure 11A:
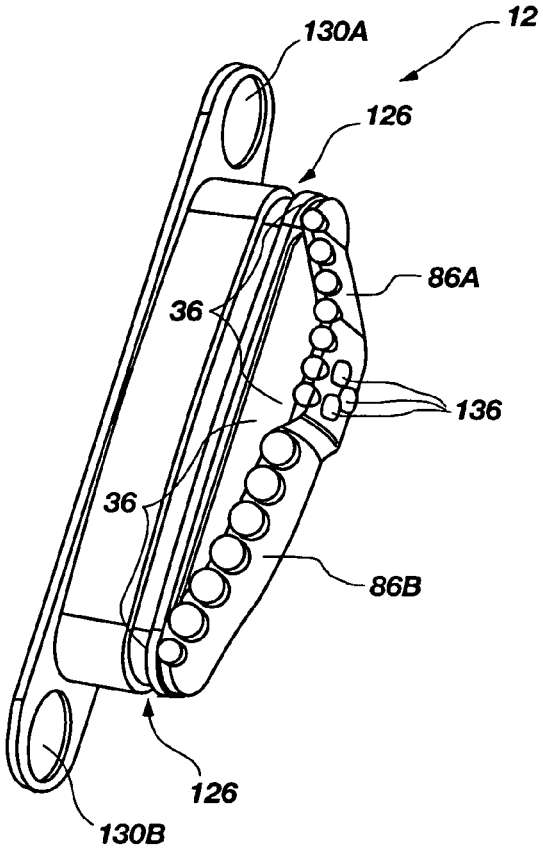
FIGS. 11A and 11B show perspective views of movable blades of an expandable reamer of the present invention including depth-of-cut-limiting surfaces and structures, respectively.

In further detail, a movable blade may include a bearing surface configured for inhibiting a rotationally following (or preceding) cutting element from overengaging a subterranean formation and potentially damaging the cutting element. FIG. 11A shows a movable blade 12 having bearing surfaces 86A and 86B configured for inhibiting a rotationally following (or preceding) cutting element from overengaging a subterranean formation. Of course, at least one of bearing surfaces 86A and 86B may include any depth-of-cut control (DOCC) features as disclosed within U.S. Pat. Nos. 6,460,631 and 6,779,613, both to Dykstra et al., or as otherwise known in the art, without limitation.

Figure 11B:
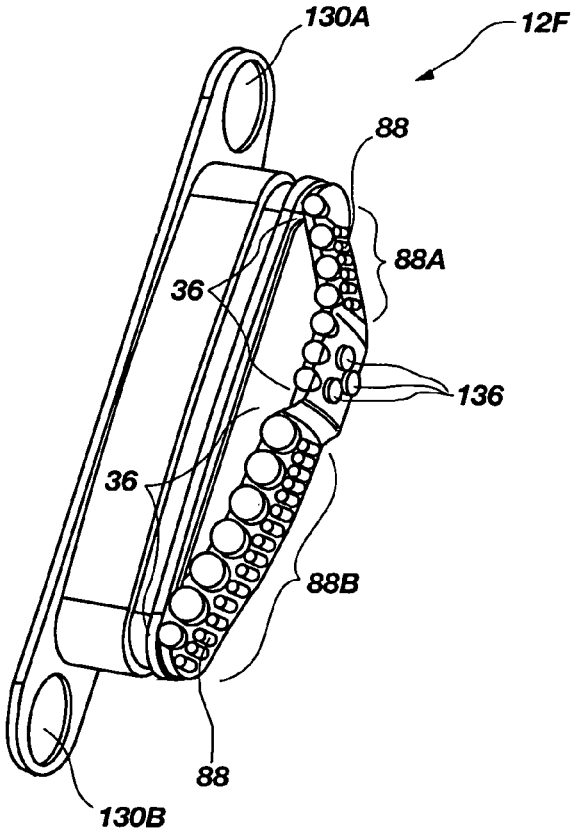

Additionally, optionally, wear knots or other bearing structures may be formed upon a movable blade or an expandable reamer. For example, FIG. 11B shows a movable blade 12F including a plurality of the depth-of-cut-limiting features, each comprising an arcuate bearing segment 88. Specifically, regions 88A and 88B including bearing segments 88 may each reside at least partially on movable blade 12F. The arcuate bearing segments 88, each of which lies substantially along the same radius from the bit centerline as a cutting element (not shown) that rotationally trails that bearing segment 88, respectively, together may provide sufficient surface area to withstand the axial or longitudinal weight-on-bit (or weight-on-reamer) without exceeding the compressive strength of the formation being drilled, so that the rock does not unduly indent or fail and the penetration of cutting element (not shown) into the rock is substantially controlled. Further, such a configuration may also substantially limit torque-on-bit experienced by the expandable reamer. Such a configuration may substantially limit the depth-of-cut that may be achieved with the expandable reamer, which may inhibit or prevent damage to a cutting element due to an excessive depth of cut.

Further, the present invention contemplates that a depth-of-cut-limiting feature or other aspects disclosed herein related to a geometry or configuration of a movable blade may be employed upon reamers having fixed blades, such as reaming-while-drilling (RWD) tools. U.S. Pat. Nos. 6,739,416 and 6,695,080 both to Presley, et al., both assignee of the present invention, disclosures of which are incorporated herein in their entirety by this reference, disclose exemplary RWD tools.

Although the foregoing description contains many specifics, these should not be construed as limiting the scope of the present invention, but merely as providing illustrations of some exemplary embodiments. Similarly, other embodiments of the invention may be devised that do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention as disclosed herein, which fall within the meaning and scope of the claims, are to be embraced thereby.

What is claimed is:

1. An expandable reamer apparatus for subterranean drilling, comprising:

a tubular body having a longitudinal axis and a drilling fluid flow path therethrough;

a plurality of generally radially and longitudinally extending blade structures carried by the tubular body, the plurality of blade structures each comprising a movable blade having a lateral height and carrying cutting structures thereon, and wherein each moveable blade is replaceable by blades having a different lateral height;

at least one blade-biasing element for holding the movable blades of the plurality of blade structures at an innermost lateral position with a force; and an actuation sleeve positioned along an inner diameter of the tubular body and configured to selectively allow pressure of drilling fluid within the drilling fluid flow path of the tubular body to move the movable blades of the plurality of blade structures outwardly against the force in response to an actuation device engaging the actuation sleeve at a lower end thereof below the plurality of blade structures, the actuation sleeve further comprising at least one aperture through a side wall thereof above a location for engagement of the actuation device therewith.

2. The apparatus of claim 1, wherein each of the plurality of blades is substantially circumferentially symmetrically disposed about the tubular body.

3. The apparatus of claim 1, wherein the actuation sleeve is positioned within the tubular body to selectively allow pressure of drilling fluid in the drilling fluid flow path to effect movement of the movable blades of the plurality of blade structures.

4. The apparatus of claim 1, further comprising a pilot drill bit disposed below the tubular body.

5. The apparatus of claim 1, wherein the cutting structures comprise polycrystalline diamond compact cutting elements.

6. The apparatus of claim 1, wherein the blades having a different lateral height are of a different configuration than the blades having a lateral height.

7. An expandable reamer apparatus for subterranean drilling, comprising:

a tubular body having a longitudinal axis and a drilling fluid flow path therethrough;

a plurality of generally radially and longitudinally extending blade structures carried by the tubular body, the blade structures each comprising a movable blade having a lateral height and carrying cutting structures thereon, and wherein each moveable blade is replaceable by blades having a different configuration;

at least one blade-biasing element for holding the movable blades of the plurality of blade structures at an innermost lateral position with a force; and an actuation sleeve positioned along an inner diameter of the tubular body and configured to selectively allow pressure of drilling fluid within the drilling fluid flow path of the tubular body to move the movable blades of the plurality of blade structures outwardly against the force in response to an actuation device engaging the actuation sleeve at a lower end thereof below the plurality of blade structures, the actuation sleeve further comprising at least one aperture through a side wall thereof above a location for engagement of the actuation device therewith.

8. The apparatus of claim 7, wherein the plurality of blades are substantially circumferentially symmetrically disposed about the tubular body.

9. The apparatus of claim 7, further comprising an actuation structure positioned within the tubular body and adapted to selectively allow drilling fluid therein to effect movement of the movable blades of the plurality of blade structures.

10. The apparatus of claim 7, further comprising a pilot drill bit disposed below the tubular body.

* * * * *

UNITED STATES PATENT AND TRADEMARK OFFICE

CERTIFICATE OF CORRECTION

PATENT NO. : 7,681,666 B2
APPLICATION NO. : 11/875651
DATED : March 23, 2010
INVENTOR(S) : Steven R. Radford and Mark R. Kizziar It is certified that error appears in the above-identified patent and that said Letters Patent is hereby corrected as shown below:

In the specification:

| | | |
|---|---|---|
| COLUMN 1, | LINE 5, | change "RELATED APPLICATIONS" to --CROSS-REFERENCE TO RELATED APPLICATIONS-- |
| COLUMN 2, | LINE 15, | change "that, which that, when" to --that, when-- |
| COLUMN 5, | LINE 23, | change "one movable" to --one laterally movable-- |
| COLUMN 10, | LINE 49, | change "invention, and the" to --invention, the-- |
| COLUMN 11, | LINE 9, | change "**32**B," to --**32**B-- |
| COLUMN 11, | LINE 44, | change "**39**, described" to --**39**, as described-- |

Signed and Sealed this
Twenty-eighth Day of May, 2013

Teresa Stanek Rea
*Acting Director of the United States Patent and Trademark Office*